US009023563B2

(12) United States Patent
Yamamoto

(10) Patent No.: US 9,023,563 B2
(45) Date of Patent: May 5, 2015

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventor: Shinya Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 34 days.

(21) Appl. No.: 13/849,162

(22) Filed: Mar. 22, 2013

(65) Prior Publication Data

US 2014/0045111 A1 Feb. 13, 2014

(30) Foreign Application Priority Data

Aug. 10, 2012 (JP) ..... 2012-179076

(51) Int. Cl.

| | |
|---|---|
| ***G03G 5/10*** | (2006.01) |
| ***G03G 5/043*** | (2006.01) |
| ***G03G 15/00*** | (2006.01) |
| ***G03G 5/05*** | (2006.01) |
| ***G03G 5/06*** | (2006.01) |
| ***G03G 5/07*** | (2006.01) |
| ***G03G 5/147*** | (2006.01) |

(52) U.S. Cl.

CPC ..... *G03G 5/0436* (2013.01); *G03G 15/75* (2013.01); *G03G 5/0539* (2013.01); *G03G 5/0546* (2013.01); *G03G 5/0592* (2013.01); *G03G 5/0614* (2013.01); *G03G 5/064* (2013.01); *G03G 5/075* (2013.01); *G03G 5/102* (2013.01); *G03G 5/14791* (2013.01)

(58) Field of Classification Search

CPC ..... G03G 5/147; G03G 5/102
USPC ..... 430/69, 66, 58.7; 399/159, 111
See application file for complete search history.

(56) References Cited

U.S. PATENT DOCUMENTS

| | | | | |
|---|---|---|---|---|
| 6,110,629 | A | 8/2000 | Ehara et al. | |
| 6,122,467 | A | 9/2000 | Ehara et al. | |
| 2013/0252148 | A1* | 9/2013 | Korenaga et al. | 430/69 |
| 2014/0044456 | A1* | 2/2014 | Yamashita et al. | 399/159 |

FOREIGN PATENT DOCUMENTS

| | | |
|---|---|---|
| JP | A-05-099737 | 4/1993 |
| JP | A-11-327258 | 11/1999 |

* cited by examiner

*Primary Examiner* — Christopher Rodee
(74) *Attorney, Agent, or Firm* — Oliff PLC

(57) ABSTRACT

An electrophotographic photoreceptor includes a cylindrical conductive substrate that has a thickness of from 0.4 mm to 0.6 mm and a Young's modulus of from 20 GPa to 80 GPa, and a photosensitive layer that is provided on the conductive substrate, wherein an elastic deformation ratio of a layer forming the outermost surface is from 0.35% to 0.47%.

14 Claims, 7 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-179076 filed Aug. 10, 2012.

BACKGROUND

1. Technical Field

The present invention relates to an electrophotographic photoreceptor, a process cartridge, and an image forming apparatus.

SUMMARY

According to an aspect of the invention, there is provided an electrophotographic photoreceptor including a cylindrical conductive substrate that has a thickness of from 0.4 mm to 0.6 mm and a Young's modulus of from 20 GPa to 80 GPa; and a photosensitive layer that is provided on the conductive substrate, wherein an elastic deformation ratio of a layer forming the outermost surface is from 0.35% to 0.47%.

BRIEF DESCRIPTION OF THE DRAWINGS

Exemplary embodiments of the present invention will be described in detail based on the following figures, wherein.

DETAILED DESCRIPTION

Figure 1:
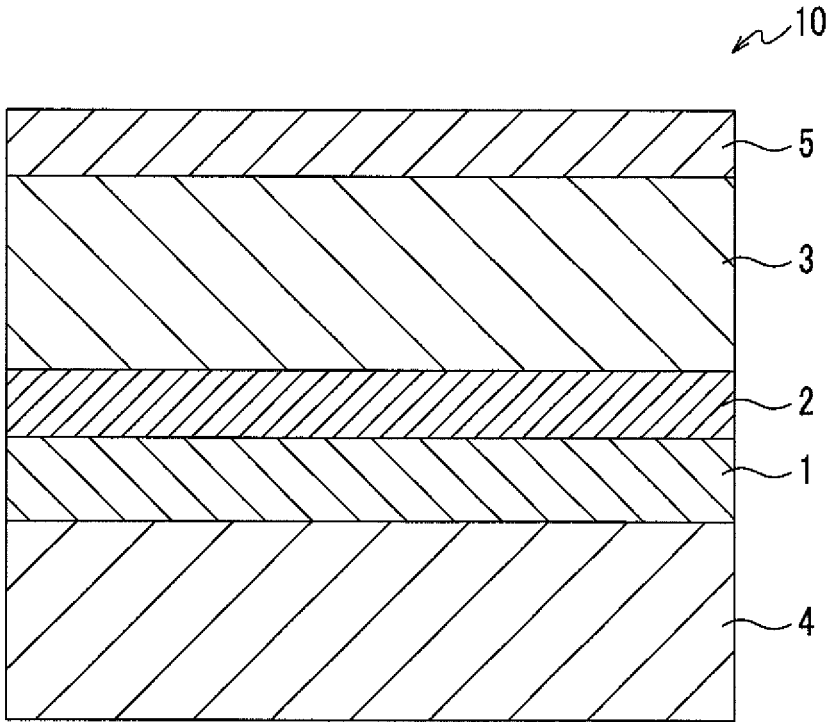
FIG. 1 is a partial cross-sectional view schematically illustrating an electrophotographic photoreceptor according to an exemplary embodiment of the invention.

Hereinafter, exemplary embodiments, which are examples of the invention, will be described in detail.

Electrophotographic Photoreceptor

An electrophotographic photoreceptor (hereinafter, also simply referred to as a "photoreceptor") according to an exemplary embodiment of the invention includes a cylindrical conductive substrate that has a thickness of from 0.4 mm to 0.6 mm and a Young's modulus of from 20 GPa to 80 GPa; and a photosensitive layer that is provided on the conductive substrate.

An elastic deformation ratio of a layer forming the outermost surface is from 0.35% to 0.47%.

In the photoreceptor according to this exemplary embodiment having the above-described configuration, the peeling of layers, formed on the conductive substrate, is suppressed.

The reason is not clear, but is considered to be as follows.

First, in the cylindrical conductive substrate that has a thickness of from 0.4 mm to 0.6 mm and a Young's modulus of from 20 GPa to 80 GPa, the thickness is thinner than that of the related art; and the Young's modulus is less than that of the related art. This cylindrical conductive substrate has effects from the viewpoints of reducing the weight and cost of, for example, the photoreceptor and an image forming apparatus (or a process cartridge) including the photoreceptor.

In the meantime, the conductive substrate having such characteristics has a characteristic of being easily deformed elastically by a mechanical load (for example, a load during rotation or an impact at the time of a fall) from the outside. When the conductive substrate is elastically deformed, layers (for example, an undercoat layer and a photosensitive layer) formed on the conductive substrate are easily peeled off.

On the other hand, when the elastic deformation ratio of the layer forming the outermost surface of the electrophotographic photoreceptor is in the above-described range and thus the electrophotographic photoreceptor has a characteristic of being difficult to elastically deform, it is considered that the layer forming the outermost surface functions as a support. In addition, it is considered that a structure is adopted in which layers formed on the conductive substrate are interposed between the layer forming the outermost surface, which is more difficult to deform than the layers formed on the conductive substrate, and the conductive substrate. Therefore, it is considered that the elastic deformation of the entire photoreceptor due to a mechanical load from the outside is suppressed.

Due to the above-described reasons, it is considered that the peeling of layers (for example, an undercoat layer and a photosensitive layer itself), formed on the conductive substrate, is suppressed.

In addition, in the photoreceptor according to this exemplary embodiment, it is considered that the elastic deformation of the entire photoreceptor due to a mechanical load from the outside is suppressed. Therefore, the cracking and the like of layers (for example, an undercoat layer and a photosensitive layer itself), formed on the conductive substrate, is also easily suppressed.

In addition, in an image forming apparatus (and a process cartridge) including the photoreceptor according to this exemplary embodiment, an image in which image defects, caused by the peeling of layers formed on the conductive substrate, are suppressed is obtained.

Hereinafter, the electrophotographic photoreceptor according to this exemplary embodiment will be described in detail with reference to the drawings.

Figure 2:
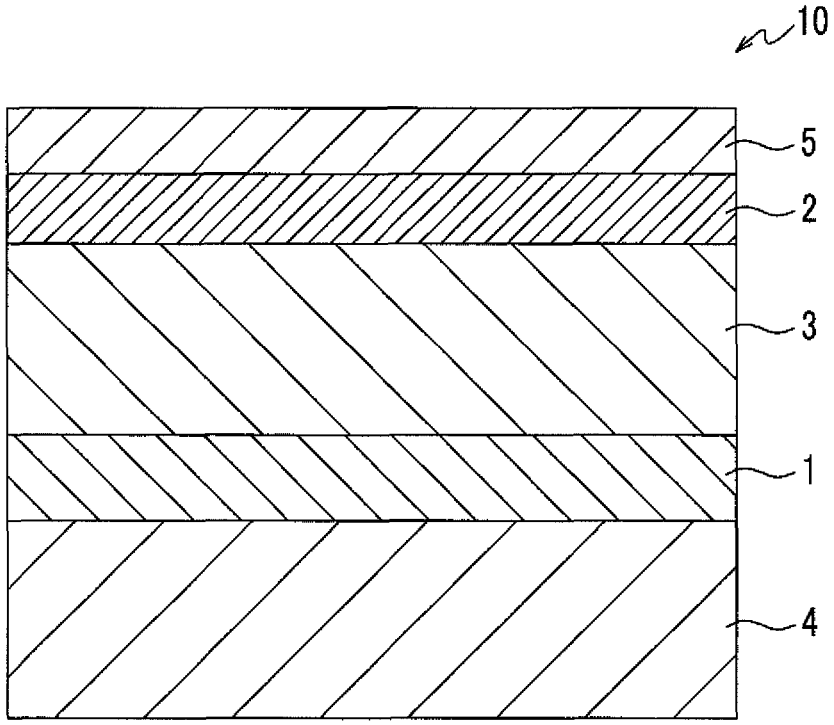
FIG. 2 is a partial cross-sectional view schematically illustrating an electrophotographic photoreceptor according to another exemplary embodiment of the invention.
Figure 3:
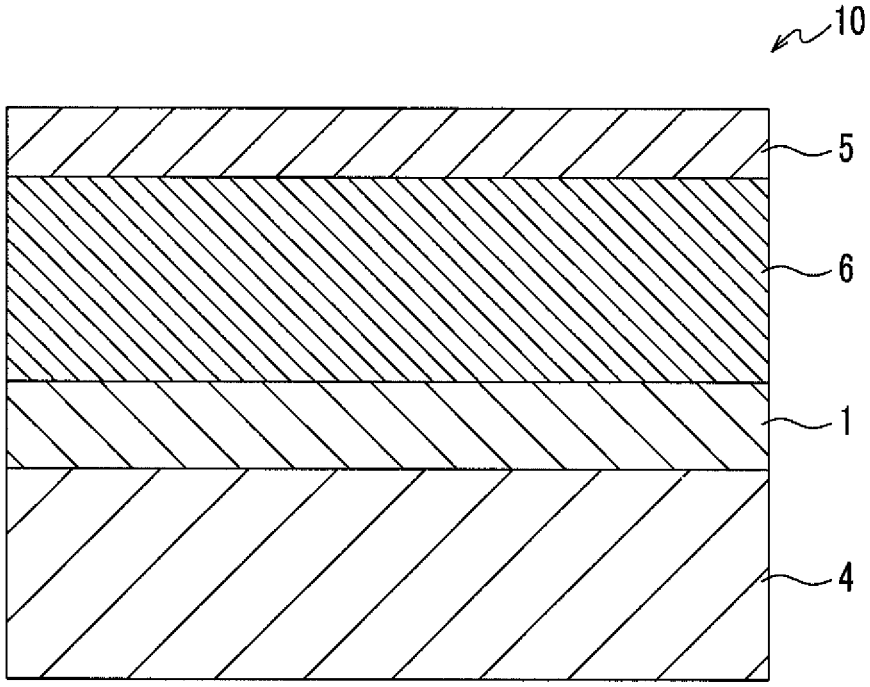
FIG. 3 is a partial cross-sectional view schematically illustrating an electrophotographic photoreceptor according to another exemplary embodiment of the invention.

FIGS. 1 to 3 are cross-sectional views schematically illustrating a part of an electrophotographic photoreceptor 10 according to this exemplary embodiment.

In an electrophotographic photoreceptor 10 illustrated in FIG. 1, an undercoat layer 1 is provided on a conductive substrate 4; a charge generation layer 2 and a charge transport layer 3, which function as a photosensitive layer, are provided on the undercoat layer 1; and a surface protective layer 5, which is the layer forming the outermost surface, is provided thereon.

Similarly to the case of the electrophotographic photoreceptor 10 illustrated in FIG. 1, an electrophotographic photoreceptor 10 illustrated in FIG. 2 includes a photosensitive layer in which the charge generation layer 2 and the charge transport layer 3 have separate functions. However, the charge transport layer 3, the charge generation layer 2, and the surface protective layer 5 are provided on the undercoat layer 1 in this order.

In an electrophotographic photoreceptor 10 illustrated in FIG. 3, a single layer, that is, a single-layer type photosensitive layer 6 (charge generation and charge transport layer) contains a charge generation material and a charge transport material; and the surface protective layer 5 is provided on the photosensitive layer 6.

In the electrophotographic photoreceptors 10 illustrated in FIGS. 1 to 3, the surface protective layer 5 is provided on the photosensitive layer; and the surface protective layer 5 is the layer forming the outermost surface. However, when the surface protective layer 5 is not provided, the uppermost layer of the photosensitive layer is the layer forming the outermost surface. Specifically, when the surface protective layer 5 is not provided in the layer configuration of the electrophotographic photoreceptor 10 illustrated in FIG. 1, the charge transport layer 3 corresponds to the layer forming the outermost surface. In addition, when the surface protective layer 5 is not provided in the layer configuration of the electrophotographic photoreceptor 10 illustrated in FIG. 3, the single-layer type photosensitive layer 6 corresponds to the layer forming the outermost surface.

Hereinafter, the respective components will be described using the electrophotographic photoreceptor 10 illustrated in FIG. 1 as a representative example. In the following description, reference numerals will be omitted.

Conductive Substrate

The conductive substrate has a cylindrical shape having a thickness of from 0.4 mm to 0.6 mm and a Young's modulus of from 20 GPa to 80 GPa.

The thickness of the conductive substrate is preferably from 0.5 mm to 0.6 mm from the viewpoint of suppressing the peeling and cracking of layers formed on the conductive substrate.

The thickness of the conductive substrate described herein is a value measured as follows.

First, layers (for example, the photosensitive layer), formed on an outer peripheral surface of the conductive substrate, are removed by a cutter or the like; or are removed by dissolving the layers in a solvent or the like.

The conductive substrate from which the layers, formed on the outer peripheral surface, are removed is set to a measurement target; and the measurement target is measured using a micrometer. This measured value is set as the thickness.

The Young's modulus is preferably from 30 GPa to 70 GPa and more preferably from 30 GPa to 50 GPa, from the viewpoints of suppressing the peeling and cracking of layers formed on the conductive substrate.

The Young's modulus of the conductive substrate is measured as follows.

First, layers (for example, the photosensitive layer), formed on an outer peripheral surface of the conductive substrate, are removed by a cutter or the like; or are removed by dissolving the layers in a solvent or the like.

Then, a measurement sample (1 mm×10 mm×10 mm) is cut from the conductive substrate, from which layers formed on the outer peripheral surface are removed. The entire measurement sample is indented at a rate of 1 mm/min using an indentation tester (trade name: MODEL-1605N, manufactured by Aikoh Engineering Co., Ltd.) to obtain the relationship between a load (N) at this time and a displacement (mm). The horizontal axis represents the displacement (mm) of the sample; and the vertical axis represents the load (N) at this time. At this time, the inclination obtained from the relationship represents a Young's modulus (GPa)

The conductive substrate is formed of a metal or an alloy. Specific examples thereof include metals such as aluminum, copper, magnesium, silicon, zinc, chromium, nickel, molybdenum, vanadium, indium, gold, platinum, and stainless steel; and alloys thereof. "Conductive" described herein represents a volume resistivity being less than $10^{13}$ Ω·cm.

Among these, it is preferable that the conductive substrate is formed of aluminum. In particular, when an aluminum substrate having a purity (content of aluminum) of 90% or higher (preferably 95% or higher and more preferably 99.5% or higher) has flexibility and is likely to be uniformly affected by a member (for example, a contact charging member) in contact with the electrophotographic photoreceptor in the process of forming an image. As a result, a desired image is easily obtained.

It is suffice that the shape of the conductive substrate is cylindrical, and the conductive substrate may be drum shaped, or belt-shaped.

The outer diameter of the conductive substrate is not particularly limited but is preferably less than or equal to 60 mm (preferably, less than or equal to 50 mm). When the outer diameter of the conductive substrate is less than or equal to 60 mm, the dimension stability is easily secured even in the case of a flexible aluminum substrate having a purity (content of aluminum) of 90% or higher.

The conductive substrate may be obtained with, for example, a method in which a workpiece formed of a metal or an alloy (hereinafter, sometimes simply referred to as "a slag") is molded into a cylindrical compact by impact pressing; and the obtained cylindrical compact is ironed to obtain a cylindrical compact having a desired thickness. After impact pressing, the cylindrical compact may be drawn and then ironed.

Figure 6C:
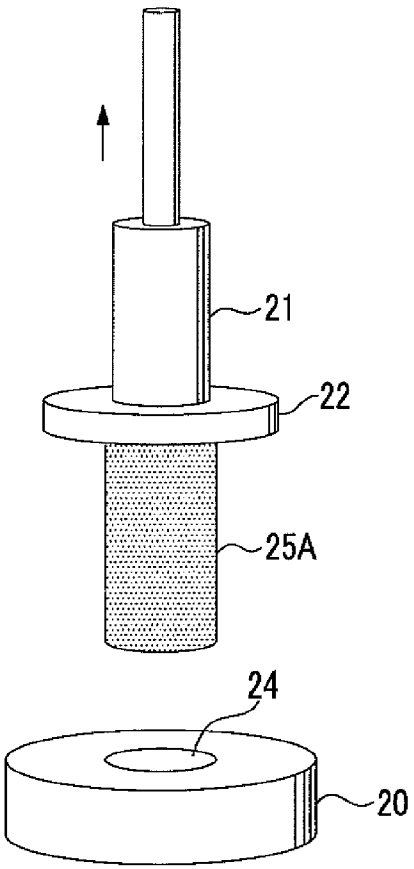
FIGS. 6A to 6C are diagrams illustrating an impact pressing process.
Figure 6B:
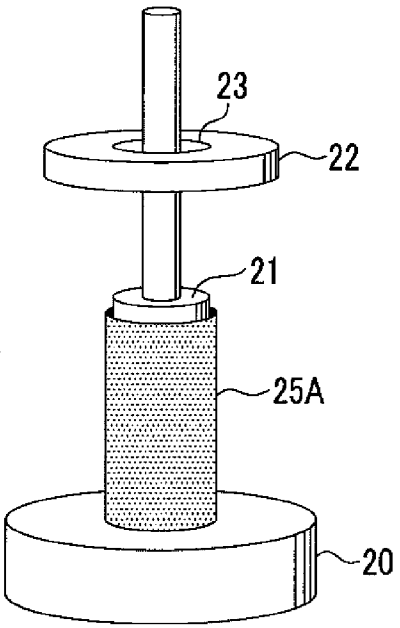
Figure 6A:
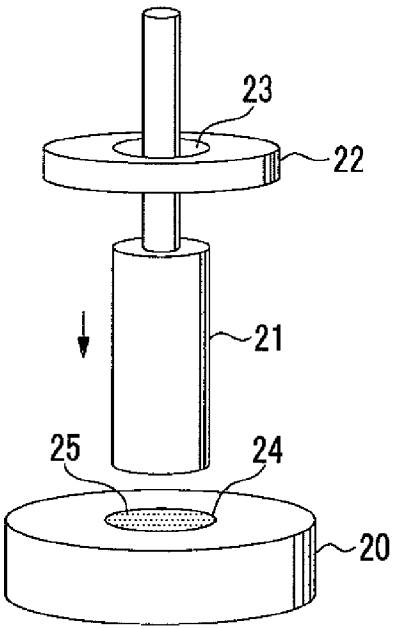

Specifically, as illustrated in FIG. 6A, a slag 25 formed of a metal or an alloy, which is coated with a lubricant, is prepared; and is set in a circular hole 24 which is provided in a die (female) 20. Next, as illustrated in FIG. 6B, the slag 25 set in the die 20 is pressed by a columnar punch (male) 21. As a result, the slag 25 is stretched and molded into a cylindrical shape from the circular hole of the die 20 so as to cover the periphery of the punch 21. After molding, as illustrated in FIG. 6C, the punch 21 is pulled up and is caused to pass through a central hole 23 of a stripper 22. As a result, the punch 21 is removed and a cylindrical compact 25A is obtained.

Figure 7B:
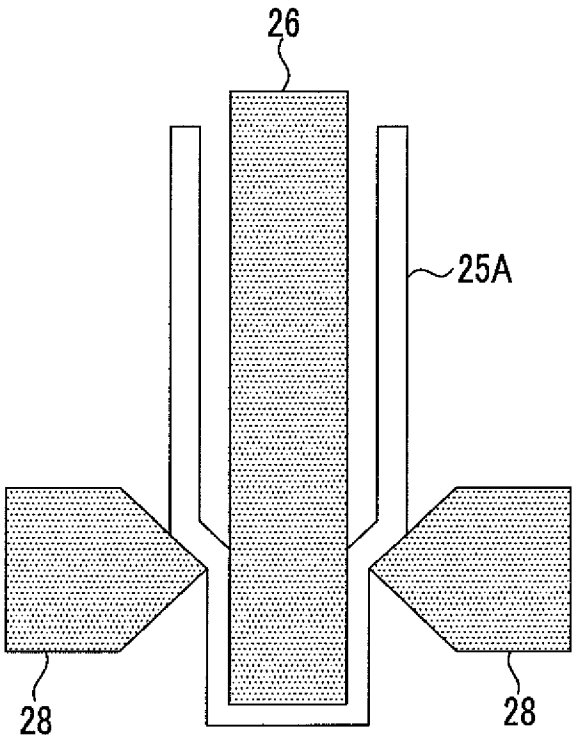
FIGS. 7A and 7B are diagrams illustrating drawing and ironing processes.
Figure 7A:
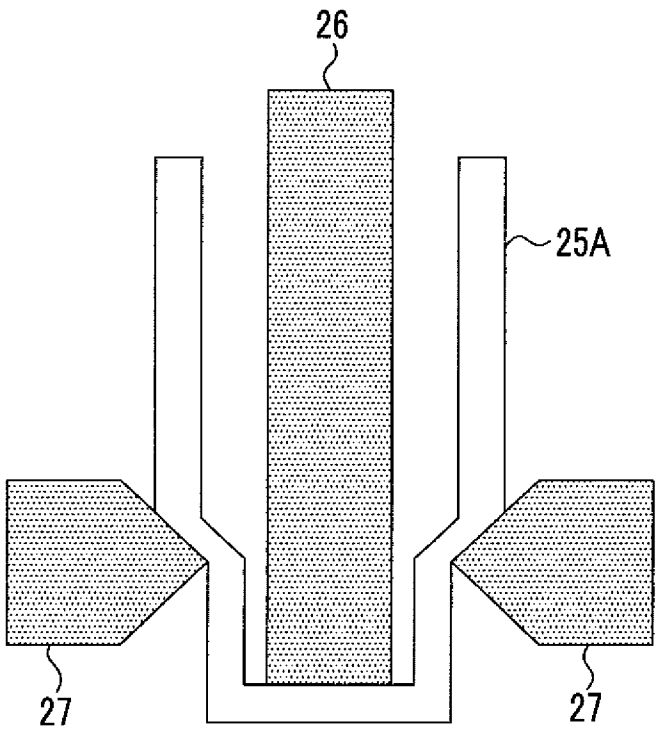

Next, as illustrated in FIG. 7A, optionally, the cylindrical compact 25A molded in the impact pressing process is pressed into a die 27 by a cylindrical punch 26 from the inside and drawn to reduce a diameter thereof; and then, is pressed into a die 28 having a smaller diameter and ironed, as illustrated in FIG. 7B.

Through the above-described processes, the conductive substrate is obtained.

In addition, the ironing process may be performed without performing the drawing process or through multiple steps.

In order to obtain the conductive substrate having the thickness and the Young's modulus within the above-described range, methods of controlling various conditions are used, for example, homogenizing conditions (heating conditions: temperature and time) of a slag formed of a metal or an alloy, conditions of processes (for example, the number of drawing and ironing), and annealing conditions (temperature and time) of the cylindrical compact after the ironing process.

The conductive substrate may be subjected in advance to various processes such as mirror-surface cutting, etching, anodic oxidation, rough cutting, centerless grinding, sand blasting, and wet honing.

In addition, when the electrophotographic photoreceptor is used as a laser printer, in order to prevent interference fringes caused when laser light is emitted, it is preferable that a surface of the conductive substrate be roughened so as to have a center line average roughness Ra of from 0.04 μm to 0.5 μm. When Ra is less than 0.04 μm, the surface has a mirror-like property and an effect of preventing interference tends to be insufficient. When Ra is greater than 0.5 μm, image quality tends to be rough even in the case of forming a coating film. When a light source which emits incoherent light is used, roughening for preventing interference fringes is not particularly necessary, and the light source is preferable from the viewpoints of increasing lifetime because defects, caused by convex and concave portions of a surface of the conductive substrate, are prevented.

Undercoat Layer

The undercoat layer is optionally provided in order to prevent light from being reflected from the surface of the conductive substrate and to prevent an unnecessary carrier from flowing from the conductive substrate to the photosensitive layer.

For example, the undercoat layer may contain a binder resin and optionally may further contain other additives.

Examples of the binder resin included in the undercoat layer include well-known polymer resin compounds such as acetal resins (for example, polyvinyl butyral), polyvinyl alcohol resins, caseins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; charge transporting resins having a charge transporting group; and conductive resins such as polyaniline. Among these, resins, which are insoluble in a coating solvent of an upper layer, are preferably used, and preferable examples thereof include phenol resins, phenol-formaldehyde resins, melamine resins, urethane resins, and epoxy resins.

The undercoat layer may contain metal compounds such as silicon compounds, organozirconium compounds, organotitanium compounds, and organoaluminum compounds.

The ratio of the metal compounds to the binder resin is not particularly limited, and is appropriately set within a range capable of obtaining desired electrophotographic photoreceptor characteristics.

Resin particles may be added to the undercoat layer in order to adjust the surface roughness. Examples of the resin particles include silicone resin particles and crosslinked polymethylmethacrylate (PMMA) resin particles. After the undercoat layer is formed, in order to adjust the surface roughness, the surface thereof may be polished. Examples of a polishing method include buffing, sand blasting, wet honing, and grinding.

In this exemplary embodiment, the undercoat layer contains, for example, at least a binder resin and conductive particles. It is preferable that the conductive particles have a volume resistivity of, for example, less than $10^7$ Ω·cm.

Examples of the conductive particles include metal particles (for example, particles of aluminum, copper, nickel, and silver), conductive metal oxide particles (for example, particles of antimony oxide, indium oxide, tin oxide, and zinc oxide), and conductive material particles (for example, particles of carbon fiber, carbon black, and graphite powder). Among these, conductive metal oxide particles are preferable. As the conductive particles, a mixture of two or more kinds may be used.

In addition, the conductive particles may be surface-treated with a hydrophobizing agent (for example, a coupling agent) so as to adjust the resistance.

The content of the conductive particles is, for example, preferably from 10% by weight to 80% by weight and more preferably from 40% by weight to 80% by weight, with respect to the binder resin.

When the undercoat layer is formed, an undercoat layer-forming coating solution, obtained by adding the above-described components to a solvent, is used.

In addition, examples of a method of dispersing particles in the undercoat layer-forming coating solution include methods using media dispersing machines such as a ball mill, a vibration ball mill, an attritor, a sand mill, and a horizontal sand mill; and media-less dispersing machines such as a stirrer, an ultrasonic disperser, a roll mill, and a high-pressure homogenizer. Examples of the high-pressure homogenizer include a collision type of dispersing a dispersion through liquid-liquid collision or liquid-wall collision in a high-pressure state; and a pass-through type of dispersing a dispersion by causing it to pass through a fine flow path in a high-pressure state.

Examples of a method of coating the undercoat layer-forming coating solution on the conductive substrate include a dip coating method, a push-up coating method, a wire bar coating method, a spray coating method, a blade coating method, a knife coating method, and a curtain coating method.

The thickness of the undercoat layer is preferably greater than or equal to 15 μm and more preferably from 20 μm to 50 μm.

Although not illustrated in the drawings, an interlayer may be further provided between the undercoat layer and the photosensitive layer. Examples of a binder resin used for the interlayer include polymer resin compounds such as acetal resins (for example, polyvinyl butyral), polyvinyl alcohol resins, caseins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organometallic compound containing zirconium, titanium, aluminum, manganese, silicon atoms, or the like. These compounds may be used alone or as a mixture or a polycondensate of plural compounds. Among these, an organometallic compound containing zirconium or silicon is preferable from the viewpoints that the residual potential is low and changes in potential resulting from the environment is small and that changes in potential resulting from the repetitive use is small.

When the interlayer is formed, an interlayer-forming coating solution, obtained by adding the above-described components to a solvent, is used.

Examples of a coating method for forming the interlayer include well-known methods such as a dip coating method, a push-up coating method, a wire bar coating method, a spray coating method, a blade coating method, a knife coating method, and a curtain coating method.

The interlayer has a function of improving coating properties of an upper layer and a function as an electrical blocking layer. When the thickness thereof is too great, an electrical barrier is too strong, which may lead to an increase in potential due to desensitization and repetitive use. Therefore, when the interlayer is formed, it is preferable that the thickness thereof be set within a range of from 0.1 μm to 3 μm. In this case, the interlayer may be used as the undercoat layer.

Charge Generation Layer

The charge generation layer contains, for example, a charge generation material and a binder resin. Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine. In particular, preferable examples thereof include chlorogallium phthalocyanine crystal having distinctive diffraction peaks with respect to CuKα characteristic X-rays at Bragg angles (2θ±0.2°) of at least 7.4°, 16.6°, 25.5°, and 28.3°; metal-free phthalocyanine crystal having distinctive diffraction peaks with respect to CuKα characteristic X-rays at Bragg angles (2θ±0.2°) of at least 7.7°, 9.3°, 16.9°, 17.5°, 22.4°, and 28.8°; hydroxygallium phthalocyanine crystal having distinctive diffraction peaks with respect to CuKα characteristic X-rays at Bragg angles (2θ±0.2°) of at least 7.5°, 9.9°, 12.5°, 16.3°, 18.6°, 25.1°, and 28.3°; and titanyl phthalocyanine crystal having distinctive diffraction peaks with respect to CuKα characteristic X-rays at Bragg angles (2θ±0.2°) of at least 9.6°, 24.1°, and 27. Other examples of the charge generation material include quinone pigments, perylene pigments, indigo pigments, bisbenzimidazole pigments, anthrone pigments, and quinacridone pigments. In addition, these charge generation materials may be used alone or as a mixture of two or more kinds.

Examples of the binder resin included in the charge generation layer include bisphenol A type or bisphenol Z type polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used alone or as a mixture of two or more kinds.

It is preferable that the mixing ratio of the charge generation material and the binder resin be, for example, from 10:1 to 1:10.

When the charge generation layer is formed, a charge generation layer-forming coating solution, obtained by adding the above-described components to a solvent, is used.

Examples of a method of dispersing particles (for example, particles of the charge generation material) in the charge generation layer-forming coating solution include methods using media dispersing machines such as a ball mill, a vibration ball mill, an attritor, a sand mill, and a horizontal sand mill; and media-less dispersing machines such as a stirrer, an ultrasonic disperser, a roll mill, and a high-pressure homogenizer. Examples of the high-pressure homogenizer include a collision type of dispersing a dispersion through liquid-liquid collision or liquid-wall collision in a high-pressure state; and a pass-through type of dispersing a dispersion by causing it to pass through a fine flow path in a high-pressure state.

Examples of a method of coating the charge generation layer-forming coating solution on the undercoat layer include a dip coating method, a push-up coating method, a wire bar coating method, a spray coating method, a blade coating method, a knife coating method, and a curtain coating method.

The thickness of the charge generation layer is set to be preferably from 0.01 μm to 5 μm and more preferably from 0.05 μm to 2.0 μm.

Charge Transport Layer

The charge transport layer contains a charge transport material and optionally further contains a binder resin.

Examples of the charge transport material include hole transporting materials such as oxadiazole derivatives (for example, 2,5-bis(p-diethylaminophenyl)-1,3,4-oxadiazole), pyrazoline derivatives (for example, 1,3,5-triphenyl-pyrazoline and 1-[pyridyl-(2)]-3-(p-diethylaminostyryl)-5-(p-diethylamino styryl)pyrazoline), aromatic tertiary amino compounds (for example, triphenylamine, N,N'-bis(3,4-dimethylphenyl) biphenyl-4-amine, tri(p-methylphenyl) aminyl-4-amine, and dibenzylaniline), aromatic tertiary diamino compounds (for example, N,N'-bis(3-methylphenyl)-N,N'-diphenylbenzidine), 1,2,4-triazine derivatives (for example, 3-(4'-dimethylamino phenyl)-5,6-di-(4'-methoxyphenyl)-1,2,4-triazine), hydrazone derivatives (for example, 4-diethylaminobenzaldehyde-1,1-diphenylhydrazone), quinazoline derivatives (for example, 2-phenyl-4-styryl-quinazoline), benzofuran derivatives (for example, 6-hydroxy-2,3-di(p-methoxyphenyl)benzofuran), α-stilbene derivatives (for example, p-(2,2-diphenylvinyl)-N,N-diphenylaniline), enamine derivatives, carbazole derivatives (for example, N-ethylcarbazole), and poly-N-vinylcarbazole and derivatives thereof; electron transport materials such as quinone compounds (for example, chloranil and bromoanthraquinone), tetracyano quinodimethane compounds, fluorenone compounds (for example, 2,4,7-trinitrofluorenone and 2,4,5,7-tetranitro-9-fluorenone), xanthone compounds, and thiophene compounds; and polymers having, at the main chain or a side chain thereof, a group derived from any of the above compounds. These charge transport material may be used alone or in a combination of two or more kinds.

Examples of the binder resin included in the charge transport layer include insulating resins such as bisphenol A type or bisphenol Z type polycarbonate resins, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber; and organic photoconductive polymers such as polyvinyl carbazole, polyvinyl anthracene, and polyvinyl pyrene. These binder resins may be used alone or as a mixture of two or more kinds.

It is preferable that the mixing ratio of the charge transport material and the binder resin be, for example, from 10:1 to 1:5.

The charge transport layer is formed using a charge transport layer-forming coating solution obtained by adding the above-described components to a solvent.

Examples of a method of dispersing particles (for example, fluororesin particles) in the charge transport layer-forming coating solution include methods using media dispersing machines such as a ball mill, a vibration ball mill, an attritor, a sand mill, a horizontal sand mill and media-less dispersing machines such as a stirrer, an ultrasonic disperser, a roll mill, and a high-pressure homogenizer. Examples of the high-pressure homogenizer include a collision type of dispersing a dispersion through liquid-liquid collision or liquid-wall collision in a high-pressure state; and a pass-through type of dispersing a dispersion by causing it to pass through a fine flow path in a high-pressure state.

Examples of a method of coating the charge transport layer-forming coating solution on the charge generation layer include well-known methods such as a dip coating method, a push-up coating method, a wire bar coating method, a spray coating method, a blade coating method, a knife coating method, and a curtain coating method.

The thickness of the charge transport layer is set to be preferably from 5 μm to 50 μm and more preferably 10 μm to 40 μm.

Surface Protective Layer

First, characteristics of the surface protective layer will be described.

The elastic deformation ratio of the surface protective layer (layer forming the outermost surface) is from 0.35% to 0.47%, preferably from 0.37% to 0.45%, and more preferably from 0.4% to 0.44%.

When the elastic deformation ratio is greater than or equal to 0.35%, the peeling of layers formed on the conductive substrate is suppressed. Meanwhile, when the elastic deformation ratio is less than or equal to 0.47%, image defects, caused by an excessively high elastic deformation ratio, are suppressed while suppressing the peeling of layers formed on the conductive substrate.

The elastic deformation ratio of the surface protective layer (layer forming the outermost surface) is a value measured as follows.

First, the surface protective layer (layer forming the outermost surface) is cut from the photoreceptor by a cutter or the like to obtain a measurement sample having the same thickness as that of the layer.

Next, a Berkovich indenter (triangular pyramidal diamond indenter, angle between edges: 115° C., curvature radius of apex: 0.1 μm or less) is vertically pressed against a surface of the measurement sample at a stress of 0.3 mN. Then, the stress applied to the indenter is returned again to 0 mN. The elastic deformation ratio is calculated, based on the following expression, from the indentation depth obtained when the indenter is pressed at a stress of 0.3 mN; and the displacement of the indenter measured after the stress is released. The measurement is performed in a measurement environment of 22° C. and 55% RH.

Expression: $ED = (D - M)/D$

In the expression, ED represents the elastic deformation ratio (%); M represents the displacement (m) of the indenter after the stress is released; and D represents the indentation depth (m)). In this case, the diamond indenter is mounted to an ultra micro hardness tester (manufactured by Shimadzu Corporation, "DUH-201"); the indentation depth is obtained from the displacement of the indenter; and the indentation load is obtained by a load cell included in the indenter.

Next, the configuration of the surface protective layer will be described.

The surface protective layer is configured by a cured film of a composition containing a reactive charge transport material. That is, the surface protective layer is configured by a cured film containing a polymer (or a crosslinked material) of a reactive charge transport material.

Examples of a configuration of the surface protective layer (layer forming the outermost surface), which satisfies the elastic deformation ratio within the above-described range, include 1) a configuration using a cured film of a composition that contains a reactive charge transport material having an —OH group as a reactive functional group and a reactive charge transport material having an $—OCH_3$ group as a reactive functional group (a configuration containing a polymer or a crosslinked material of a reactive charge transport material having an —OH group as a reactive functional group and a reactive charge transport material having an $—OCH_3$ group as a reactive functional group); 2) a configuration using a cured film of a composition that contains a reactive charge transport material and at least one kind selected from a guanamine compound and a melamine compound (a configuration containing a polymer or a crosslinked material of a reactive charge transport material and at least one kind selected from a guanamine compound and a melamine compound); and 3) a configuration using a cured film of a composition that contains a reactive charge transport material and a resin having a functional group (a configuration containing a polymer or a crosslinked material of a reactive charge transport material and a resin having a functional group).

From the viewpoint of suppressing the peeling of layers formed on the conductive substrate, the content (solid content concentration in a coating solution) of the reactive charge transport material having an $—OCH_3$ group is, for example, from 0.1 time to 3.0 times that of the reactive charge transport material having an —OH group. The content may be from 0.2 time to 1.5 times or from 0.3 time to 1.0 time.

From the viewpoint of suppressing the peeling of layers formed on the conductive substrate, the content (solid content concentration in a coating solution) of the reactive charge transport material having an $—OCH_3$ group is, for example, from 10% by weight to 70% by weight with respect to the total solid content other than fluororesin particles and an alkyl fluoride group-containing copolymer. The content may be from 20% by weight to 50% by weight or from 25% by weight to 45% by weight.

Meanwhile, from the viewpoint of suppressing the peeling of layers formed on the conductive substrate, the content (solid content concentration in a coating solution) of the reactive charge transport material having an —OH group is, for example, from 30% by weight to 90% by weight with respect to the total solid content other than fluororesin particles and an alkyl fluoride group-containing copolymer. The content may be from 40% by weight to 75% by weight or from 45% by weight to 60% by weight.

The reactive charge transport material will be described.

Examples of the reactive charge transport material include reactive charge transport materials having an —OH group, an $—OCH_3$ group, an $—NH_2$ group, an —SH group, or a —COOH group as a reactive functional group. In addition, other examples thereof include well-known reactive charge transport materials having a group having an unsaturated double bond (for example, a vinyl group) as a reactive functional group.

As described above, from the viewpoint of suppressing the peeling of layers formed on the conductive substrate, it is preferable that the reactive charge transport material having an OH group and the reactive charge transport material having an $—OCH_3$ group be used in combination as the reactive charge transport material.

It is preferable that the reactive charge transport material be a charge transport material having at least two (preferably, three) reactive functional groups. In this way, by increasing the number of the reactive functional groups included in the charge transport material, the crosslink density is increased, a cured film (crosslinked film) having a higher strength may be obtained, the elastic deformation ratio of the surface protective layer is easily adjusted, and the peeling of layers formed on the conductive substrate is easily suppressed.

It is preferable that the reactive charge transport material be a compound represented by Formula (I).

$$F—((—R^{13}—X)_{n1}(R^{14})_{n2}—Y)_{n3} \quad (I)$$

In Formula (I), F represents an organic group (charge transporting skeleton) derived from a compound having a charge transporting capability; $R^{13}$ and $R^{14}$ each independently represent a linear or branched alkylene group having from 1 to 5 carbon atoms; n1 represents 0 or 1; n2 represents 0 or 1; and n3 represents an integer of from 1 to 4. X represents an oxygen atom, NH or a sulfur atom; and Y represents a reactive functional group.

Regarding the organic group derived from a compound having a charge transporting capability, which is represented by F in Formula (I), preferable examples of the compound having a charge transporting capability include arylamine derivatives. Preferable examples of the arylamine derivatives include triphenylamine derivatives and tetraphenylbenzidine derivatives.

It is preferable that the compound represented by Formula (I) be a compound represented by Formula (II). The compound represented by Formula (II) has, in particular, superior charge mobility and stability to oxidation and the like.

(II)

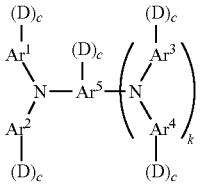

In Formula (II), $Ar^1$ to $Ar^4$ may be the same as or different from each other and each independently represent a substituted or unsubstituted aryl group; $Ar^5$ represents a substituted or unsubstituted aryl group or a substituted or unsubstituted arylene group; D represents $—(—R^{13}—X)_{n1}(R^{14})_{n2}—Y$; c's each independently represent 0 or 1; k represents 0 or 1; and the total number of D's is from 1 to 4. In addition, $R^{13}$ and $R^{14}$ each independently represent a linear or branched alkylene group having from 1 to 5 carbon atoms; n1 represents 0 or 1; n2 represents 0 or 1; X represents an oxygen atom, NH, or a sulfur atom; and Y represents a reactive functional group.

In the substituted aryl group and the substituted arylene group, examples of a substituent other than D include an alkyl group having from 1 to 4 carbon atoms, an alkoxy group having from 1 to 4 carbon atoms, and a substituted or unsubstituted aryl group having from 6 to 10 carbon atoms.

"$—(—R^{13}—X)_{n1}(R^{14})_{n2}—Y$" represented by D in Formula (II) is the same as in Formula (I), and $R^{13}$ and $R^{14}$ each independently represent a linear or branched alkylene group having from 1 to 5 carbon atoms. In addition, it is preferable that n1 represent 1. In addition, it is preferable that n2 represent 1. In addition, it is preferable that X represent an oxygen atom.

The total number of D in Formula (II) corresponds to n3 in Formula (I), and is preferably from 2 to 4 and more preferably 3 or 4.

In addition, in Formula (I) or (II), when the total number of D in one molecule is from 2 to 4 and preferably 3 or 4, the crosslink density is increased and a crosslinked film having a higher strength may be obtained, and in particular, the rotary torque of the electrophotographic photoreceptor, when a blade member for removing impurities is used, is reduced and thus the wear of the blade member and the wear of the electrophotographic photoreceptor are suppressed. The details are not clear. However, as described above, the reason is considered to be that, by increasing the number of the reactive functional groups, a cured film having high crosslink density is obtained; the molecular motion on a top surface of the electrophotographic photoreceptor is suppressed; and thus the interaction with surface molecules of the blade member is weakened.

It is preferable that $Ar_1$ to $Ar_4$ in Formula (II) represent a compound represented by any one of Formulae (1) to (7). Formulae (1) to (7) are shown with "$-(D)_C$" which may be linked to each of $Ar_1$ to $Ar_4$.

(1)

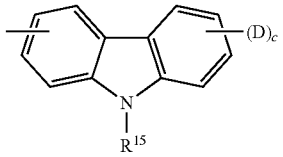

(2)

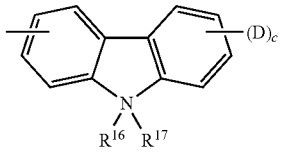

(3)

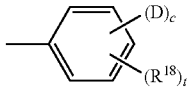

(4)

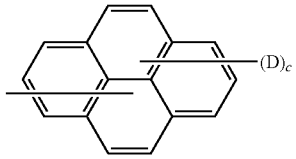

(5)

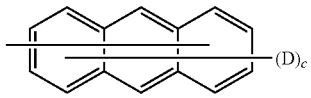

(6)

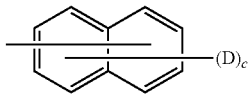

(7)

$—Ar—(Z')_s—Ar—(D)_c$

In Formulae (1) to (7), $R^{15}$ represents one kind selected from a group consisting of a hydrogen atom, an alkyl group having from 1 to 4 carbon atoms, a phenyl group which is substituted with an alkyl group having from 1 to 4 carbon atoms or an alkoxy group having from 1 to 4 carbon atoms, an unsubstituted phenyl group, and an aralkyl group having from 7 to 10 carbon atoms; $R^{16}$ to $R^{18}$ each independently represent one kind selected from a group consisting of a hydrogen atom, an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; Ar represents a substituted or unsubstituted arylene group; D and c are the same "D" and "c" in Formula (II); s represents 0 or 1; and t represents an integer of from 1 to 3.

In this case, it is preferable that Ar in Formula (7) represent a compound represented by Formula (8) or (9).

(8)

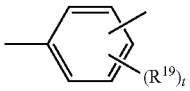

(9)

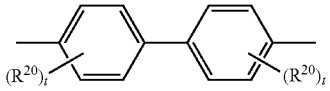

In Formulae (8) and (9), $R^{19}$ and $R^{20}$ each independently represent one kind selected from a group consisting of a hydrogen atom, an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; and t represents an integer of from 1 to 3.

In addition, it is preferable that Z' in Formula (7) represent a compound represented by any one of Formulae (10) to (17).

(10)

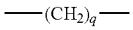

(11)

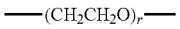

(12)

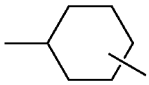

(13)

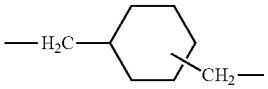

(14)

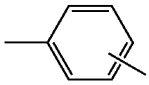

(15)

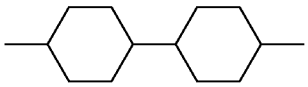

(16)

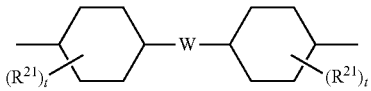

(17)

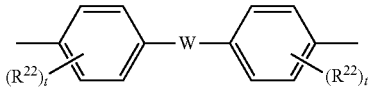

In Formulae (10) to (17), $R^{21}$ and $R^{22}$ each independently represent one kind selected from a group consisting of a hydrogen atom, an alkyl group having from 1 to 4 carbon atoms, an alkoxy group having from 1 to 4 carbon atoms, a phenyl group which is substituted with an alkoxy group having from 1 to 4 carbon atoms, an unsubstituted phenyl group, an aralkyl group having from 7 to 10 carbon atoms, and a halogen atom; W represents a divalent group; q and r each independently represent an inter of from 1 to 10; and t's each independently represent an integer of 1 to 3.

It is preferable that W in Formulae (16) and (17) represent a divalent group represented by any one of Formulae (18) to (26). However, u in Formula (25) represents an integer of from 0 to 3.

(18)

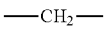

(19)

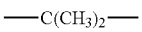

(20)

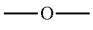

(21)

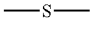

(22)

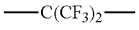

(23)

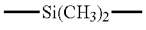

(24)

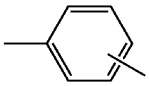

(25)

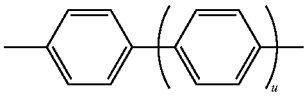

(26)

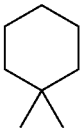

In addition, when k represents 0, $Ar^5$ in Formula (II) represents the aryl group in Formulae (1) to (7) which is described above as an example in the description of $Ar^1$ to $Ar^4$; and, when k represents 1, represents an arylene group obtained by removing a hydrogen atom from the aryl group in Formulae (1) to (7).

Specific examples of the compound represented by Formula (I) include the following compounds. However, the compound represented by Formula (I) is not limited thereto.

I-1

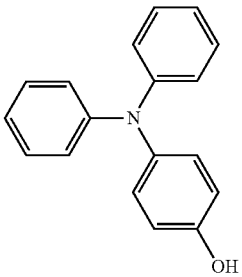

I-2

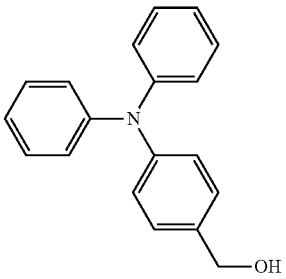

-continued
I-3
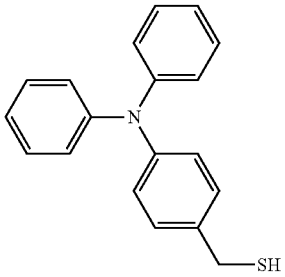
I-4
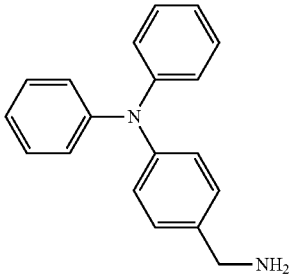
I-5
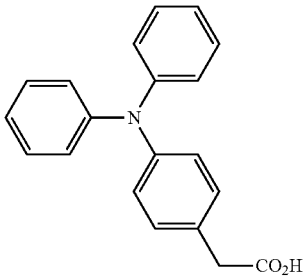
I-6
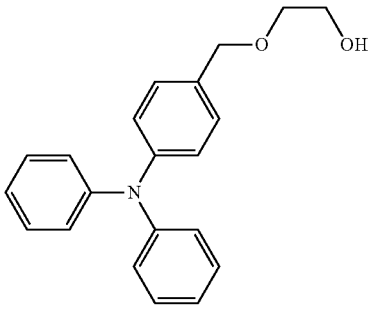
I-7
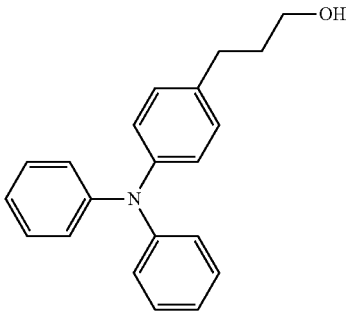
-continued
I-8
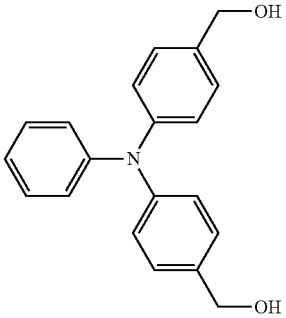
I-9
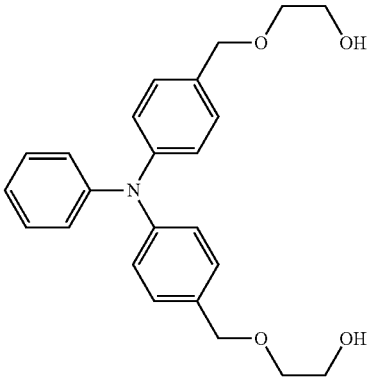
I-10
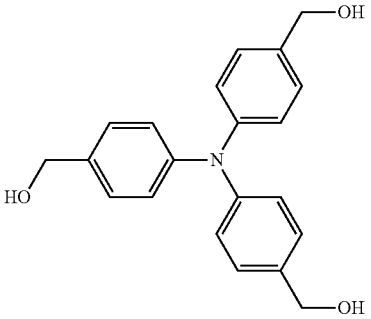
I-11
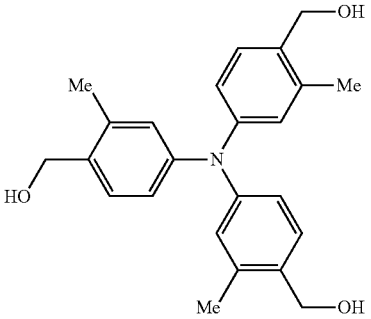

-continued
I-12
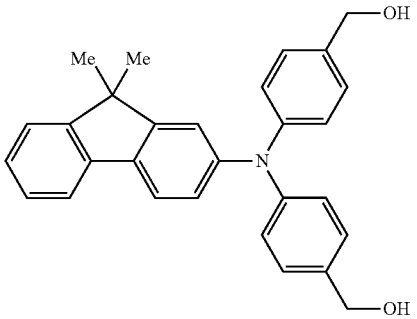
I-13
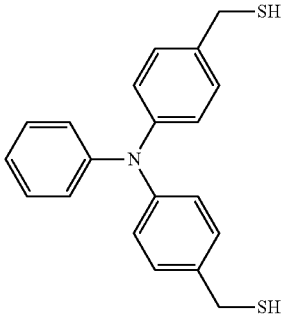
I-14
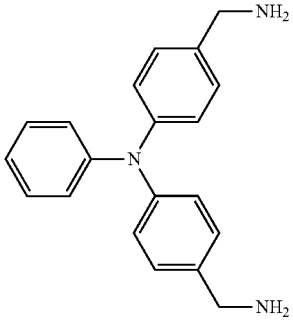
I-15
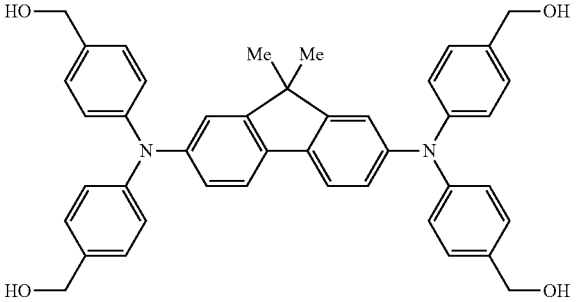
I-16
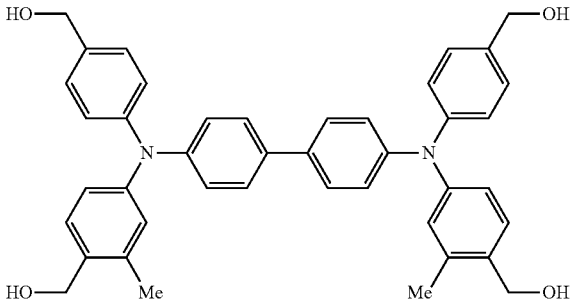
-continued
I-17
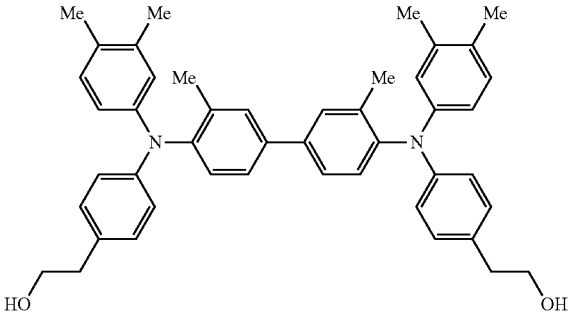
I-18
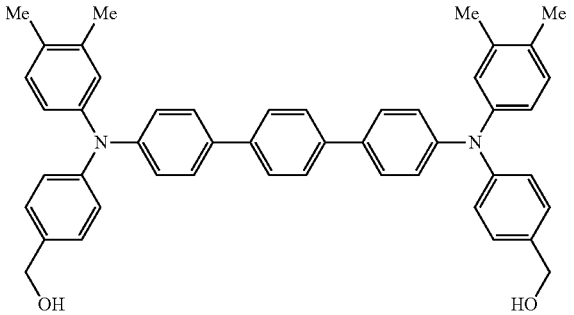
I-19
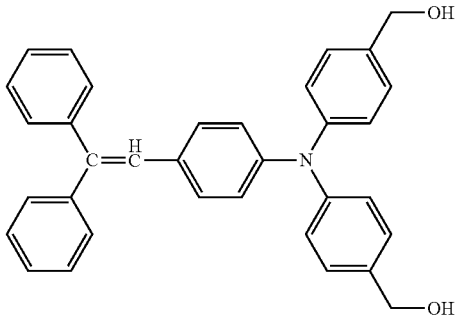
I-20
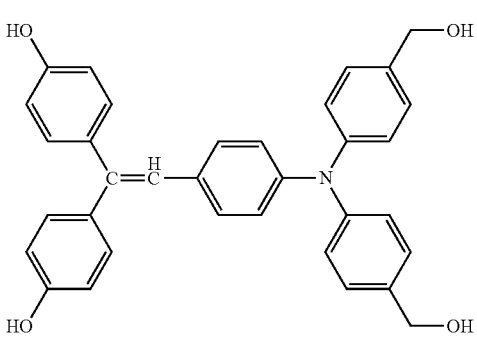

-continued
I-21
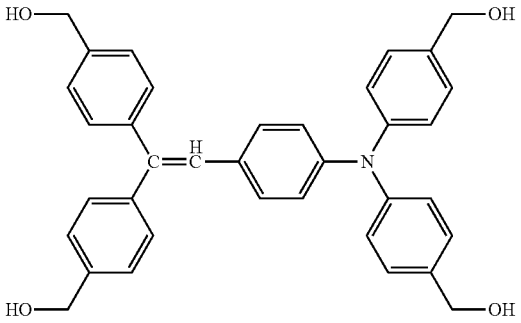
I-22
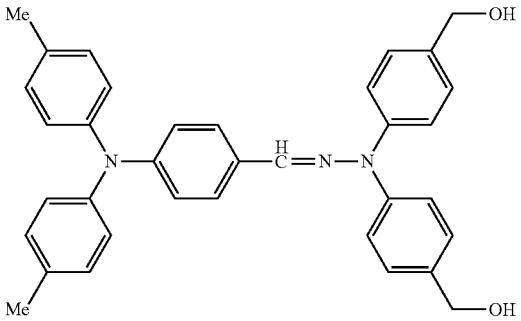
I-23
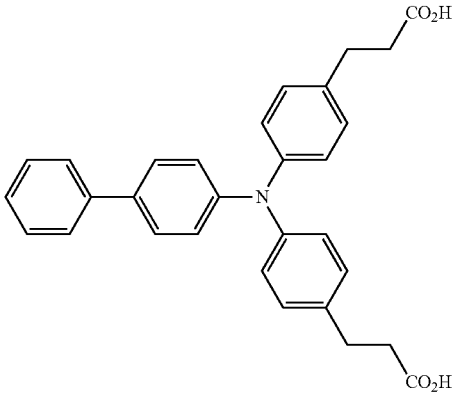
I-24
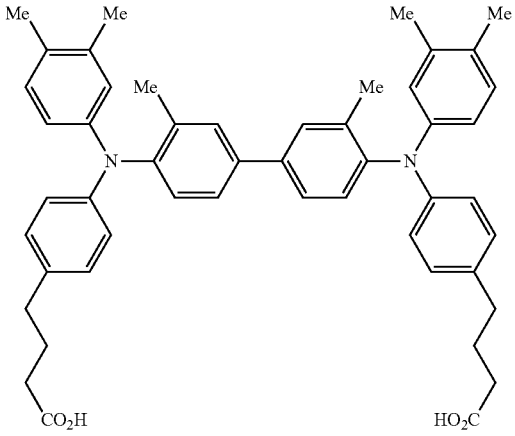
-continued
I-25
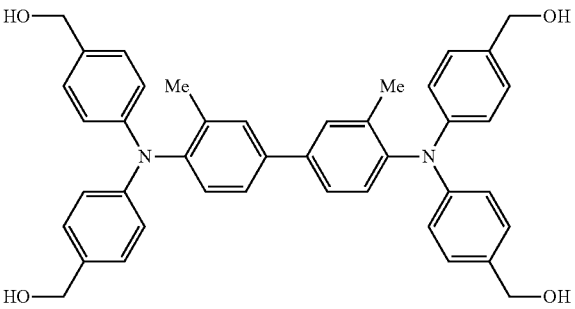
I-26
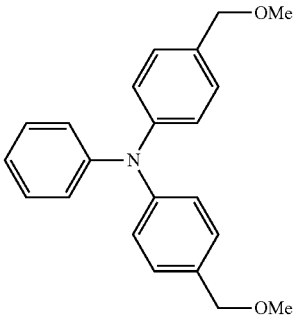
I-27
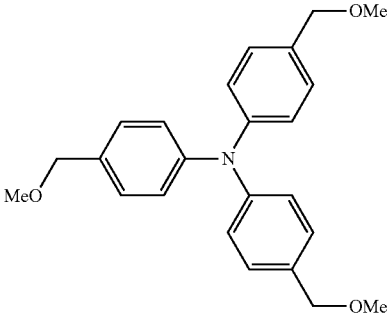
I-28
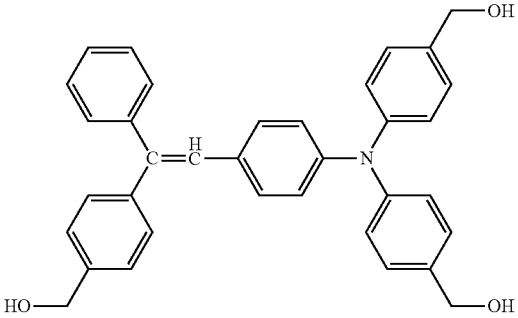

-continued

I-29

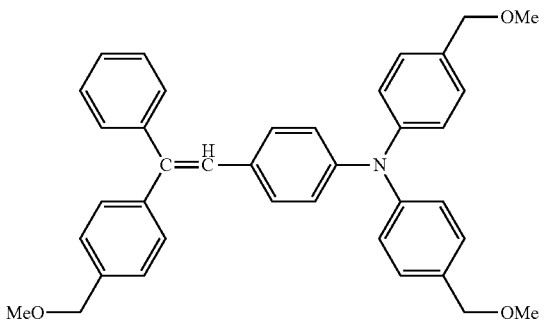

I-30

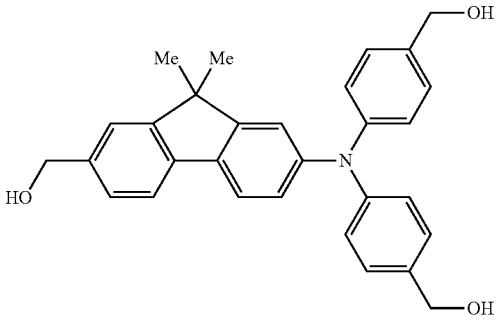

I-31

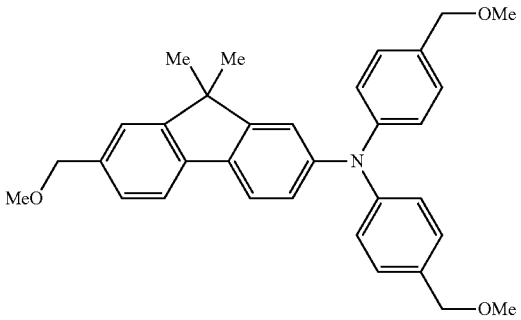

I-32

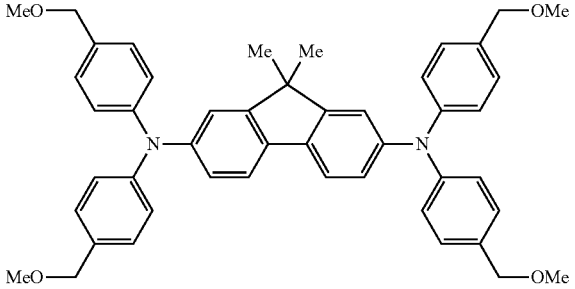

-continued

I-33

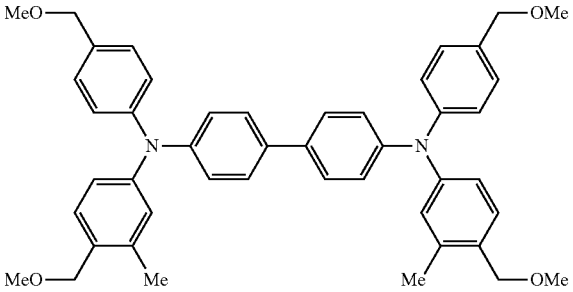

I-34

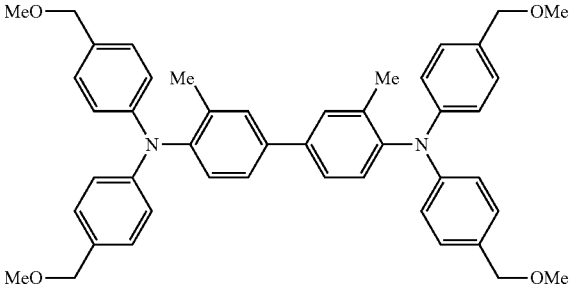

The content (solid content concentration in a coating solution) of the reactive charge transport material is, for example, greater than or equal to 80% by weight, preferably greater than or equal to 90% by weight, and more preferably greater than or equal to 95% by weight, with respect to all the components (solid content) of the layer other than fluororesin particles and an alkyl fluoride group-containing copolymer. When the solid content concentration is less than 90% by weight, electrical characteristics may deteriorate. As long as other additives function effectively, the upper limit of the content of the reactive charge transport material is not limited and it is preferable that the upper content be higher.

Next, the guanamine compound will be described.

The guanamine compound is a compound having a guanamine skeleton (structure), and examples thereof include acetoguanamine, benzoguanamine, formoguanamine, steroguanamine, spiroguanamine, and cyclohexylguanamine.

It is particularly preferable that the guanamine compound be at least one kind of a compound represented by Formula (A) and a polymer thereof. The polymer described herein represents an oligomer which is polymerized using the compound represented by Formula (A) as a structural unit. The polymerization degree thereof is, for example, from 2 to 200 (preferably, from 2 to 100). As the compound represented by Formula (A), one kind may be used alone or two or more kinds may be used in combination. In particular, as the compound represented by Formula (A), when a mixture of two or more kinds is used or a polymer (oligomer) having the mixture as a structural unit is used, the solubility in a solvent is improved.

(A)

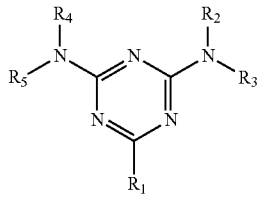

In Formula (A), $R_1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R_2$ to $R_5$ each independently represent a hydrogen atom, —$CR_2$—OH, or —$CH_2$—O—$R_6$. $R_6$ represents a linear or branched alkyl group having from 1 to 10 carbon atoms.

In Formula (A), the number of carbon atoms included in the alkyl group represented by $R_1$ is from 1 to 10, preferably from 1 to 8, and more preferably from 1 to 5. In addition, the alkyl group may be linear or branched.

In Formula (A), the number of carbon atoms included in the phenyl group represented by $R_1$ is from 6 to 10 and preferably from 6 to 8. Examples of a substituent with which the phenyl group is substituted include a methyl group, an ethyl group, and a propyl group.

In Formula (A), the number of carbon atoms included in the alicyclic hydrocarbon group represented by $R_1$ is from 4 to 10 and preferably from 5 to 8. Examples of a substituent with which the alicyclic hydrocarbon group is substituted include a methyl group, an ethyl group, and a propyl group.

In "—$CH_2$—O—$R_6$" which is represented by $R_2$ to $R_5$ in Formula (A), the number of carbon atoms included in the alkyl group represented $R_6$ is from 1 to 10, preferably from 1 to 8, and more preferably from 1 to 6. In addition, the alkyl group may be linear or branched. Preferable examples thereof include a methyl group, an ethyl group, and a butyl group.

It is particularly preferable that the compound represented by Formula (A) be a compound in which $R_1$ represents a substituted or unsubstituted phenyl group having from 6 to 10 carbon atoms; and $R_2$ to $R_5$ each independently represent a compound represented by —$CH_2$—O—$R_6$. In addition, it is preferable that $R_6$ represent one selected from a methyl group or an n-butyl group.

The compound represented by Formula (A) is synthesized using, for example, guanamine and formaldehyde according to a well-known method (for example, a method described in Jikken Kagaku Koza 4th edition, The Chemical Society of Japan, vol. 28, p. 430).

Hereinafter, exemplary compounds (A)-1 to (A)-42 will be shown as specific examples of the compound represented by Formula (A), but the exemplary embodiments are not limited thereto. In addition, the following specific examples are monomers, but may be polymers (oligomers) having the monomers as a structural unit. In the following exemplary compounds, "Me" represents a methyl group, "Bu" represents a butyl group, and "Ph" represents a phenyl group.

(A)-1

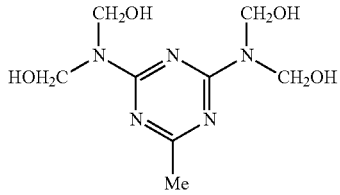

(A)-2

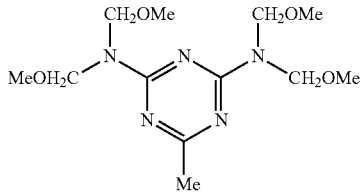

(A)-3

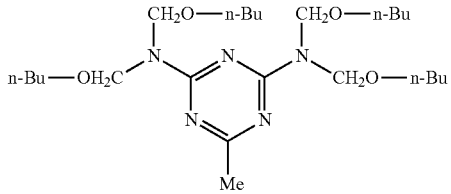

(A)-4

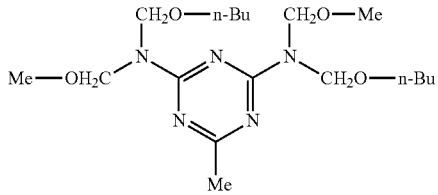

(A)-5

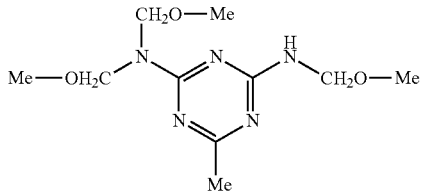

(A)-6

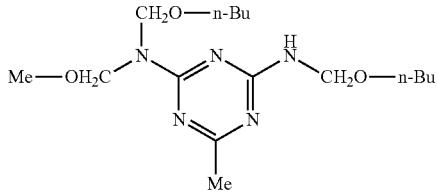

(A)-7

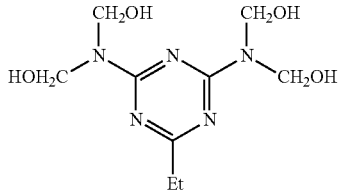

(A)-8

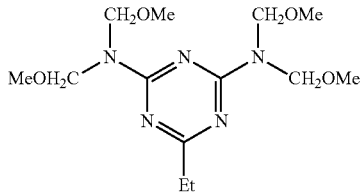

-continued
(A)-9
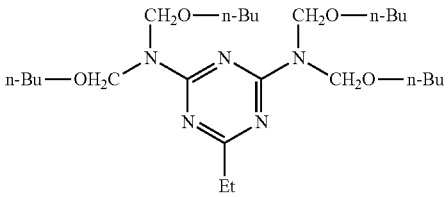
(A)-10
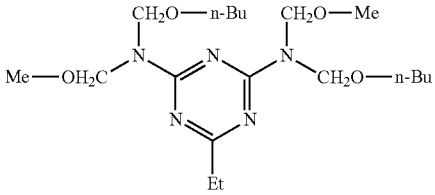
(A)-11
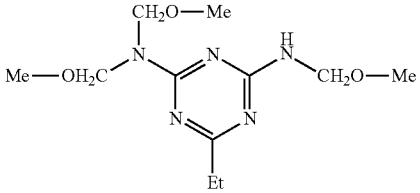
(A)-12
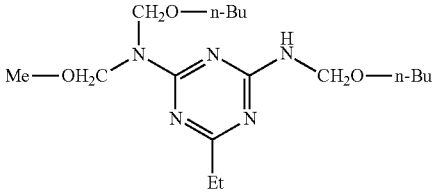
(A)-13
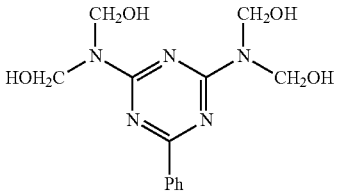
(A)-14
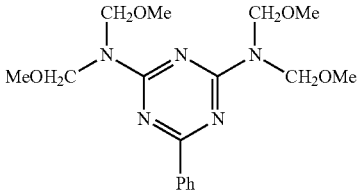
(A)-15
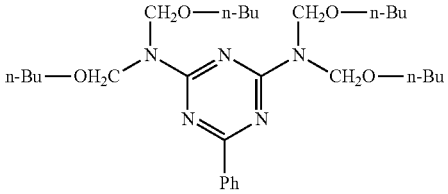
(A)-16
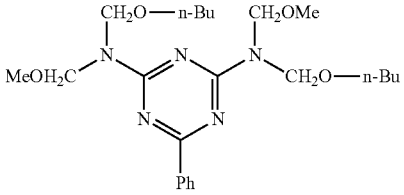
-continued
(A)-17
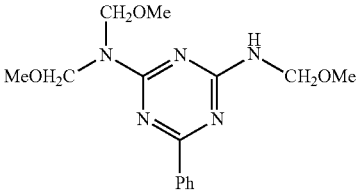
(A)-18
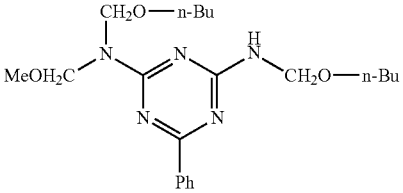
(A)-19
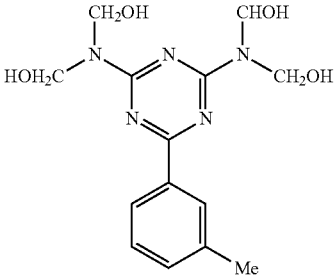
(A)-20
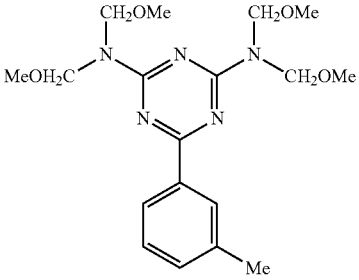
(A)-21
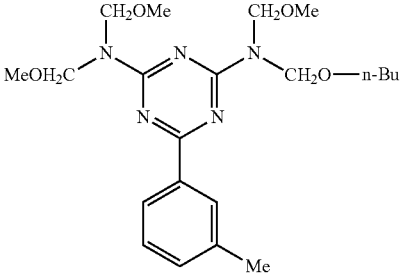
(A)-22
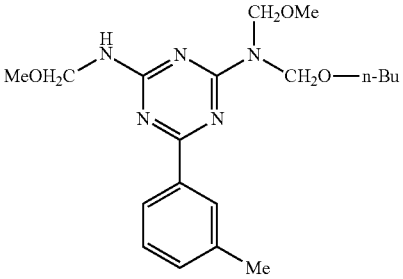

-continued
(A)-23
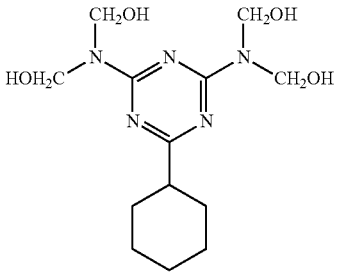
(A)-24
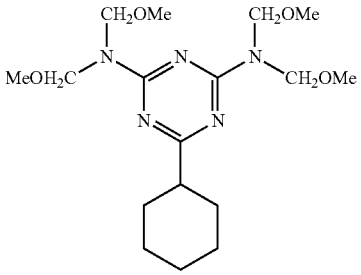
(A)-25
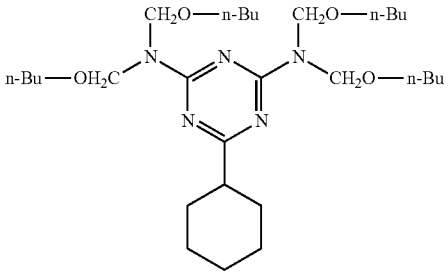
(A)-26
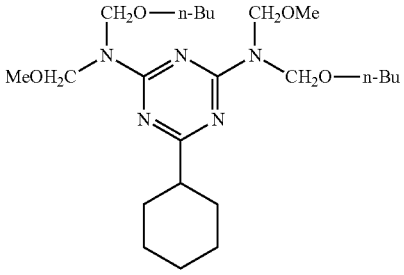
(A)-27
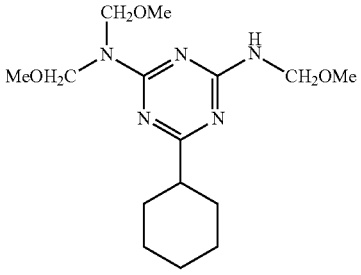
-continued
(A)-28
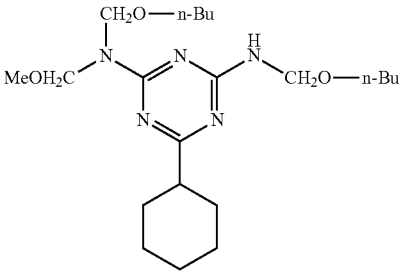
(A)-29
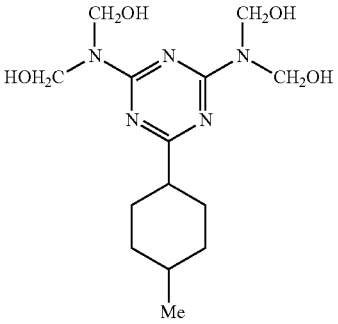
(A)-30
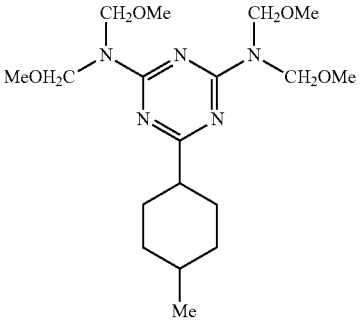
(A)-31
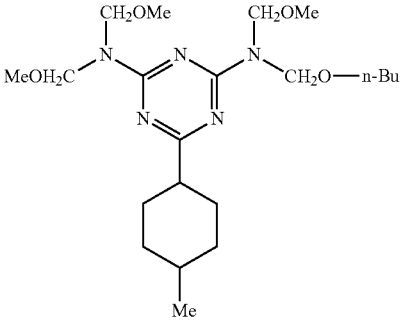
(A)-32
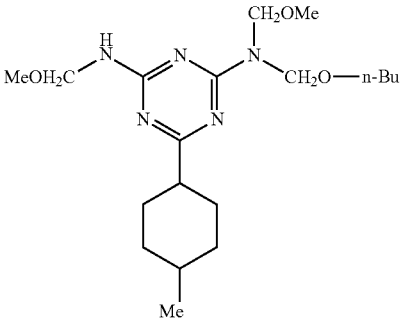

-continued (A)-33

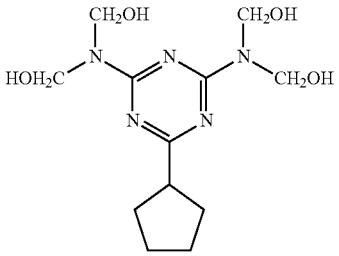

(A)-34

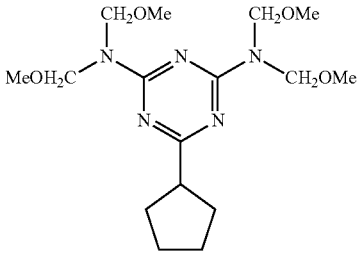

(A)-35

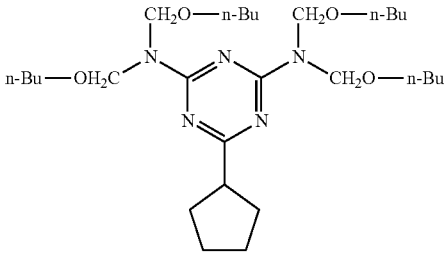

(A)-36

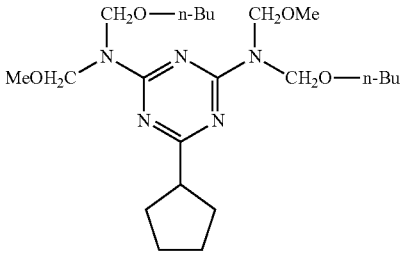

(A)-37

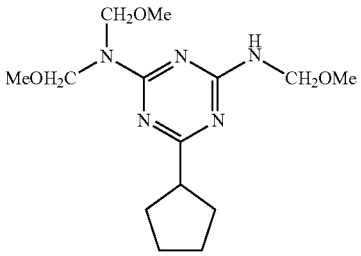

(A)-38

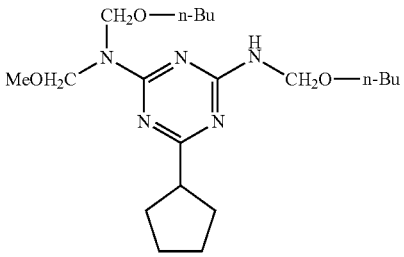

-continued (A)-39

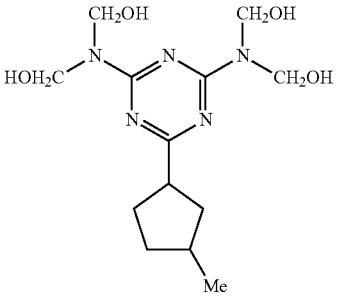

(A)-40

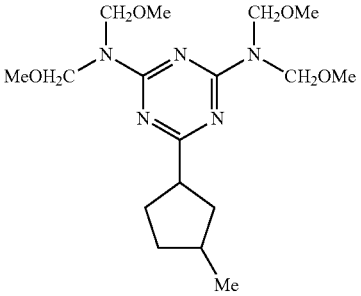

(A)-41

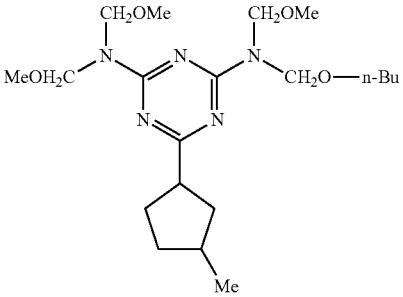

(A)-42

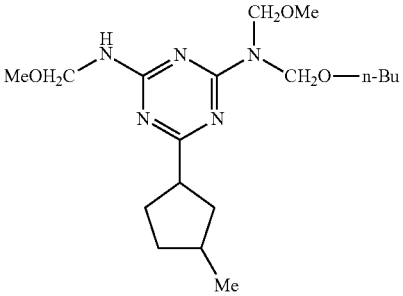

Examples of commercially available products of the compound represented by Formula (A) include SUPER BECKAMINE (R) L-148-55, SUPER BECKAMINE (R) 13-535, SUPER BECKAMINE (R) L-145-60 and SUPER BECKAMINE (R) TD-126 (all of which are manufactured by DIC Corporation); and NIKALAC BL-60 and NIKALAC BX-4000 (both of which are manufactured by Nippon Carbide Industries Co., Inc.).

In addition, after the compound (including a polymer) represented by Formula (A) is synthesized or a commercially available product thereof is purchased, in order to remove effects of a residual catalyst, the compound may be dissolved in an appropriate solvent such as toluene, xylene, or ethyl acetate and washed with distilled water, ion exchange water, or the like; or may be treated with an ion exchange resin.

Next, the melamine compound will be described.

It is particularly preferable that the melamine compound be at least one kind of a compound represented by Formula (B)

and a polymer thereof which is a compound having a melamine skeleton (structure). Similarly to the case of Formula (A), the polymer described herein represents an oligomer which is polymerized using the compound represented by Formula (B) as a structural unit. The polymerization degree thereof is, for example, from 2 to 200 (preferably, from 2 to 100). As the compound represented by Formula (B) or the polymer thereof, one kind may be used alone or two or more kinds may be used in combination. The compound represented by Formula (B) may be used in combination with the compound represented by Formula (A) or polymers thereof. In particular, as the compound represented by Formula (B), when a mixture of two or more kinds is used or a polymer (oligomer) having the mixture as a structural unit is used, the solubility in a solvent is improved.

(B)

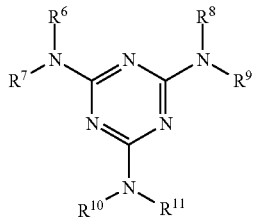

In Formula (B), $R^6$ to $R^{11}$ each independently represent a hydrogen atom, —$CH_2$—OH, —$CH_2$—O—$R^{12}$, or —O—$R^{12}$; and $R^{12}$ represents an alkyl group having from 1 to 5 carbon atoms which may be branched. Examples of the alkyl group include a methyl group, an ethyl group, and a butyl group.

The compound represented by Formula (B) is synthesized using, for example, melamine and formaldehyde according to a well-known method (for example, the same synthesis method as that of a melamine resin described in Jikken Kagaku Koza 4th edition, vol. 28, p. 430).

Hereinafter, exemplary compounds (B)-1 to (B)-8 will be shown as specific examples of the compound represented by Formula (B), but the exemplary embodiments are not limited thereto. In addition, the following specific examples are monomers, but may be polymers (oligomers) having the monomers as a structural unit.

(B)-1

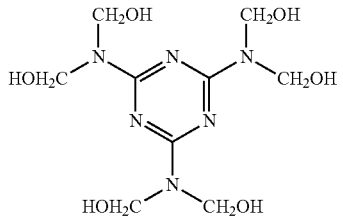

(B)-2

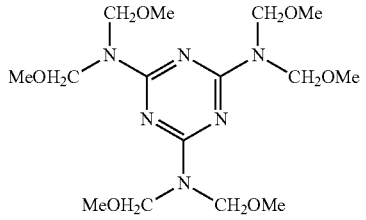

-continued (B)-3

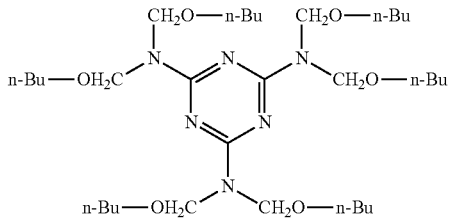

(B)-4

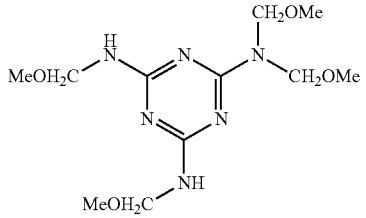

(B)-5

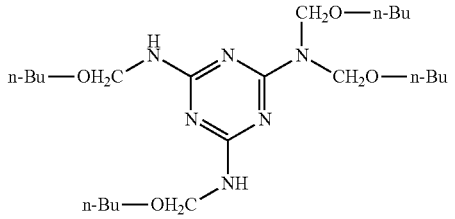

(B)-6

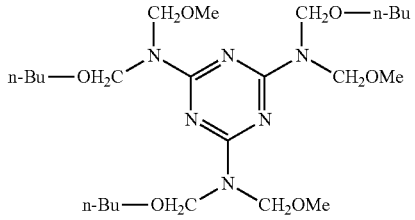

(B)-7

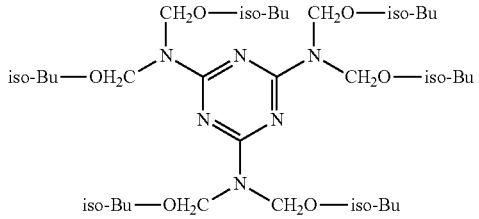

(B)-8

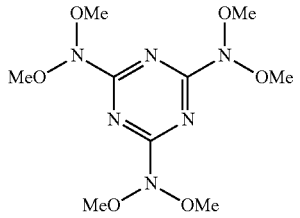

Examples of commercially available products of the compound represented by Formula (B) include SUPER MELAMI No. (manufactured by NOF Corporation), SUPER. BECKAMINE (R) TD-139-60 (manufactured by DIC Corporation), UBAN 2020 (manufactured by Mitsui Chemicals Inc.), SUMITEX RESIN M-3 (manufactured by Sumitomo Chemical Co., Ltd.), and NIKALAC MW-30 (manufactured by Nippon Carbide Industries Co., Inc.).

In addition, after the compound (including a polymer) represented by Formula (B) is synthesized or a commercially available product thereof is purchased, in order to remove effects of a residual catalyst, the compound may be dissolved in an appropriate solvent such as toluene, xylene, or ethyl acetate and washed with distilled water, ion exchange water, or the like; or may be treated with an ion exchange resin.

The content (solid content concentration in a coating solution) of at least one kind selected from the guanamine compound (compound represented by Formula (A)) and the melamine compound (compound represented by Formula (B)) is, for example, preferably from 0.1% by weight to 5% by weight and more preferably from 1% by weight to 3% by weight, with respect to all the components (solid content) of the layer other than fluororesin particles and an alkyl fluoride group-containing copolymer. When this solid content concentration is less than 0.1% by weight, a film is difficult to be dense and therefore a sufficient strength is difficult to be obtained. When the solid content concentration is greater than 5% by weight, electric characteristics and ghosting (unevenness in density caused by an image history) resistance may deteriorate.

Hereinafter, the surface protective layer will be described in more detail.

For example, fluororesin particles may be added to the surface protective layer.

The fluororesin particles are not particularly limited, but examples thereof include particles of polytetrafluoroethylene, perfluoroalkoxy fluororesin, polychlorotrifluoroethylene, polyvinyl idene fluoride, polydichlorodifluoroethylene, tetrafluoroethylene-perfluoroalkylvinylether copolymer, tetrafluoroethylene-hexafluoropropylene copolymer, tetrafluoroethylene-ethylene copolymer, and tetrafluoroethylene-hexafluoropropylene-perfluoroalkylvinylether copolymer.

As the fluororesin particles, one kind may be used alone, or two or more kinds may be used in combination.

It is preferable that the weight average molecular weight of the fluororesin which forms the fluororesin particles be, for example, from 3,000 to 5,000,000.

The average primary particle diameter of the fluororesin particles is, for example, preferably from 0.01 μm to 10 μm and more preferably from 0.05 μm to 2.0 μm.

In this case, the average primary particle diameter of the fluororesin particles represents a value which is obtained by measuring a measurement solution, diluted with the same solvent as a dispersion in which the fluororesin particles are dispersed, at a refractive index of 1.35 using a laser diffraction particle diameter analyzer LA-700 (manufactured by HORIBA Ltd.).

Examples of commercially available products of the fluororesin particles include LUBRON series (manufactured by DAIKIN INDUSTRIES Ltd.), TEFLON (registered trademark) series (manufactured by E.I. du Pont de Nemours and Company), and DYNEON series (manufactured by Sumitomo 3M Ltd.).

The content of the fluororesin particles is, for example, preferably from 1% by weight to 30% by weight and more preferably from 2% by weight to 20% by weight, with respect to all of the components of the layer (in terms of solid content).

Next, the alkyl fluoride group-containing copolymer will be described.

It is preferable that the alkyl fluoride group-containing copolymer have repeating units represented by Structural Formulae (A) and (B).

The alkyl fluoride group-containing copolymer is a material which functions as a dispersant of the fluororesin particles, but other dispersants of the fluororesin particles may be used instead of the alkyl fluoride group-containing copolymer.

Structural Formula (A)

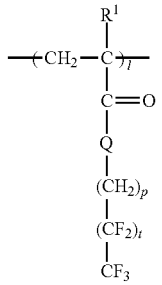

Structural Formula (B)

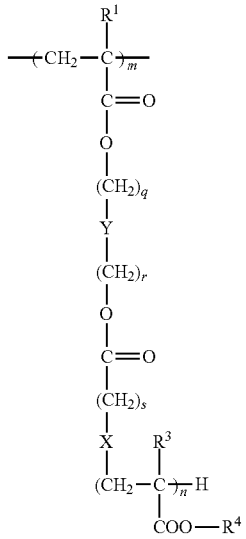

In Structural Formulae (A) and (B), $R^1$, $R^2$, $R^3$, and $R^4$ each independently represent a hydrogen atom or an alkyl group.

X represents an alkylene chain, a halogen-substituted alkylene chain, —S—, —O—, —NH—, or a single bond.

Y represents an alkylene chain, a halogen-substituted alkylene chain, —($C_zH_{2z-1}$ (OH))—, or a single bond.

Q represents —O— or —NH—.

l, m, and n each independently represent an integer of 1 or more.

p, q, r, and s each independently represent 0 or an integer of 1 or more.

t represents an integer of 1 to 7.

z represents an integer of 1 or more.

As the groups represented by $R^1$, $R^2$, $R^3$, and $R^4$, a hydrogen atom, a methyl group, or an ethyl group is preferable and a methyl group is more preferable.

It is preferable that the alkylene chains represented by X and Y (an unsubstituted alkylene chain and a halogen-substituted alkylene chain) be an alkylene chain having from 1 to 10 carbon atoms.

In—($C_zH_{2z-1}$ (OH))— represented by Y, it is preferable that z represent an integer of from 1 to 10.

It is preferable that p, q, r, and s each independently represent 0 or an integer of from 1 to 10.

In the alkyl fluoride group-containing copolymer, the ratio of content of Structural Formula (A) to Structural Formula (B), that is, l:m is preferably from 1:9 to 9:1 and more preferably from 3:7 to 7:3.

In Structural Formulae (A) and (B), examples of the alkyl group represented by $R^1$, $R^2$, $R^3$, and $R^4$ include a methyl group, an ethyl group and a propyl group. As $R^1$, $R^2$, $R^3$, and $R^4$, a hydrogen atom and a methyl group is preferable and a methyl group is more preferable.

The alkyl fluoride group-containing copolymer may further include a repeating unit represented by Structural Formula (C). The ratio of the total content of Structural Formula (A) and Structural Formula (B) to the content of Structural Formula (C), that is, 1+m:z is preferably from 10:0 to 7:3 and more preferably from 9:1 to 7:3.

Structural Formula (C)

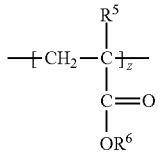

In Structural Formula (C), $R^5$ and $R^6$ represent a hydrogen atom or an alkyl group. z represents an integer of 1 or more.

As the groups represented by $R^5$ and $R^6$, a hydrogen atom, a methyl group, and an ethyl group are preferable and a methyl group is more preferable.

Examples of commercially available products of the alkyl fluoride group-containing copolymer include GF-300 and GF-400 (manufactured by Toagosei Co., Ltd.); SURFLON series (manufactured by AGC Seimi Chemical Co., Ltd.); FTERGENT series (manufactured by Neos Company Limited); PF series (manufactured by Kitamura Chemicals Co., Ltd.); MEGAFACE series (manufactured by DIC Corporation); and FC series (manufactured by 3M Company).

As the alkyl fluoride group-containing copolymer, one kind may be used alone or two or more kinds may be used in combination.

The weight average molecular weight of the alkyl fluoride group-containing copolymer is preferably from 2,000 to 250,000 and more preferably from 3,000 to 150,000.

The weight average molecular weight of the alkyl fluoride group-containing copolymer is measured using gel permeation chromatography (GPC).

The content of the alkyl fluoride group-containing copolymer is, for example, preferably from 0.5% by weight to 10% by weight and more preferably from 1% by weight to 7% by weight, with respect to the weight of the fluororesin particles.

Hereinafter, the surface protective layer will be described in further detail.

It is preferable that an antioxidant be added to the surface protective layer in order to prevent deterioration due to oxidizing gas such as ozone which is generated in a charging device.

Examples of the antioxidant include well-known antioxidants such as hindered phenol-based antioxidants, aromatic amine-based antioxidants, hindered amine-based antioxidants, organic sulfur-based antioxidants, phosphite-based antioxidants, dithiocarbamate-based antioxidants, thiourea-based antioxidants, and benzimidazole-based antioxidants.

In the surface protective layer, the reactive charge transport material (for example, a compound represented by Formula (I)) may be used in combination with a phenol resin, a urea resin, an alkyd resin, or the like. In addition, in order to improve strength, it is also effective that a compound having more functional groups in a single molecule such as spiroacetal guanamine resin (for example, "CTU-guanamine" (manufactured by Ajinomoto Fine Techno Co., Inc.)) be copolymerized with a material in the crosslinked material.

In order to efficiently suppress the oxidation due to discharge gas, another thermo-setting resin such as phenol resin may be added and mixed into the surface protective layer such that the discharge gas is not excessively adsorbed to the surface protective layer.

It is preferable that a surfactant be added to the surface protective layer. The surfactant is not particularly limited as long as it includes fluorine atoms and at least one structure of an alkylene oxide structure and a silicone structure, but the surfactant having the plural above-described structures is preferable because the affinity and the compatibility to a charge transport organic compound are high, the layer forming property of a surface protective layer-forming coating solution is improved, and wrinkles and unevenness in the surface protective layer are suppressed.

In the surface protective layer, a coupling agent or a fluorine compound may be used in order to adjust the film forming property, the flexibility, the lubricity, the adhesion, and the like of a layer. As such a compound, various silane coupling agents and commercially available silicone hard-coating agents are used.

A resin which is soluble in alcohol may be added to the surface protective layer, for the purposes of resistance to discharge gas, mechanical strength, scratch resistance, particle dispersibility, viscosity control, torque reduction, wear amount control, an increase in pot life (the preservability of a layer-forming coating solution), and the like.

In this case, the resin which is soluble in alcohol indicates a resin of which 1% by weight or greater is soluble in an alcohol having from 5 or less carbon atoms. Examples of the resin which is soluble in alcohol include polyvinyl acetal resin and polyvinyl phenol resin.

Various particles may be added to the surface protective layer in order to lower residual potential or to improve strength. An example of the particles includes silicon-containing particles. The silicon-containing particles include silicon atoms as a constituent element, and specific examples thereof include colloidal silica particles and silicone particles.

For the same purpose, oil such as silicone oil may be added to the surface protective layer.

Metal, metal oxide, carbon black, or the like may be added to the surface protective layer.

It is preferable that the surface protective layer be a cured layer (cross-linked layer) in which the reactive charge transport materials and optionally, at least one kind selected from the guanamine compound and the melamine compound are polymerized (cross-linked) using an acid catalyst. Examples of the acid. catalyst include aliphatic carboxylic acids such as acetic acid, chloroacetic acid, trichloroacetic acid, trifluoroacetic acid, oxalic acid, maleic acid, malonic acid, and lactic acid; aromatic carboxylic acids such as benzoic acid, phthalic acid, terephthalic acid, and trimellitic acid; and aliphatic and aromatic sulfonic acids such as methanesulfonic acid, dodecylsulfonic acid, benzenesulfonic acid, dodecylbenzenesulfonic acid, and naphthalenesulfonic acid. Among these, a sulfur-containing material is preferable.

In this case, the content of the catalyst is preferably from 0.1% by weight to 50% by weight and more preferably from 10% by weight to 30% by weight, with respect to all of the components of the layer (in terms of solid content) other than fluororesin particles and the alkyl fluoride group-containing copolymer. When the content is less than the above-described range, catalytic activity may be too low, and when the content is greater than the above-described range, lightfastness may deteriorate. Lightfastness indicates a phenomenon in which, when the photosensitive layer is exposed to light emitted from the outside such as room illumination, the density of an exposed portion is reduced. The reason is not clear but it is presumed that the same phenomenon as an optical memory effect disclosed in JP-A-5-099737 occurs.

The surface protective layer with the above-described configuration is formed using a surface protective layer-forming coating solution into which the above-described components are mixed. The surface protective layer-forming coating solution may be prepared without a solvent, and optionally, may be prepared with a solvent. As such a solvent, one kind may be used alone or a mixture of two or more kinds may be used, in which the boiling point thereof is preferably less than or equal to 100° C. As the solvent, a solvent having at least one hydroxyl group (for example, alcohols) is particularly preferable.

In addition, when the coating solution is formed by a reaction of the above-described components, the components may be simply mixed and dissolved in the solvent, but may be heated at room temperature (for example, 25° C.) to 100° C. and preferably 30° C. to 80° C. for 10 minutes to 100 hours and preferably 1 hour to 50 hours. In addition, at this time, it is preferable that ultrasonic waves be applied thereto. As a result, a partial reaction may advance and thus a layer with less defects and less unevenness in thickness may be obtained.

The surface protective layer-forming coating solution is coated according to a well-known method such as a blade coating method, a wire bar coating method, a spray coating method, a dip coating method, a bead coating method, an air knife coating method, or a curtain coating method, and optionally heated at a temperature of, for example, 100° C. to 170° C. to be cured. As a result, the surface protective layer is obtained.

As described above, an example of the function separation-type electrophotographic photoreceptor has been described. However, for example, when the single layer-type photosensitive layer (charge generation and charge transport layer) shown in FIG. 3 is formed, the content of the charge generation material is preferably from about 10% by weight to about 85% by weight, and more preferably from 20% by weight to 50% by weight. In addition, the content of the charge transport material is preferably from 5% by weight to 50% by weight.

A method of forming the single layer-type photosensitive layer is the same as the method of forming the charge generation layer or the charge transport layer. The thickness of the single layer-type photosensitive layer is preferably from about 5 μm to about 50 μm, and more preferably from 10 μm to 40 μm.

The electrophotographic photoreceptor according to this exemplary embodiment may not include the surface protective layer. In this configuration, for example, the reactive charge transport material, the guanamine compound, and the melamine compound used for the surface protective layer, may be added to the charge transport layer or the single layer-type photosensitive layer, which corresponds to the layer forming the outermost surface, so as to adjust the elastic deformation ratio in the above-described range.

Image Forming Apparatus and Process Cartridge

An image forming apparatus according to an exemplary embodiment of the invention includes the electrophotographic photoreceptor according to this exemplary embodiment; a charging unit that charges the electrophotographic photoreceptor; an electrostatic latent image forming unit that forms an electrostatic latent image on a charged electrophotographic photoreceptor; a developing unit that accommodates a developer containing a toner and develops the electrostatic latent image, formed on the electrophotographic photoreceptor, using the developer to form a toner image; and a transfer unit that transfers the toner image onto a transfer medium.

Figure 4:
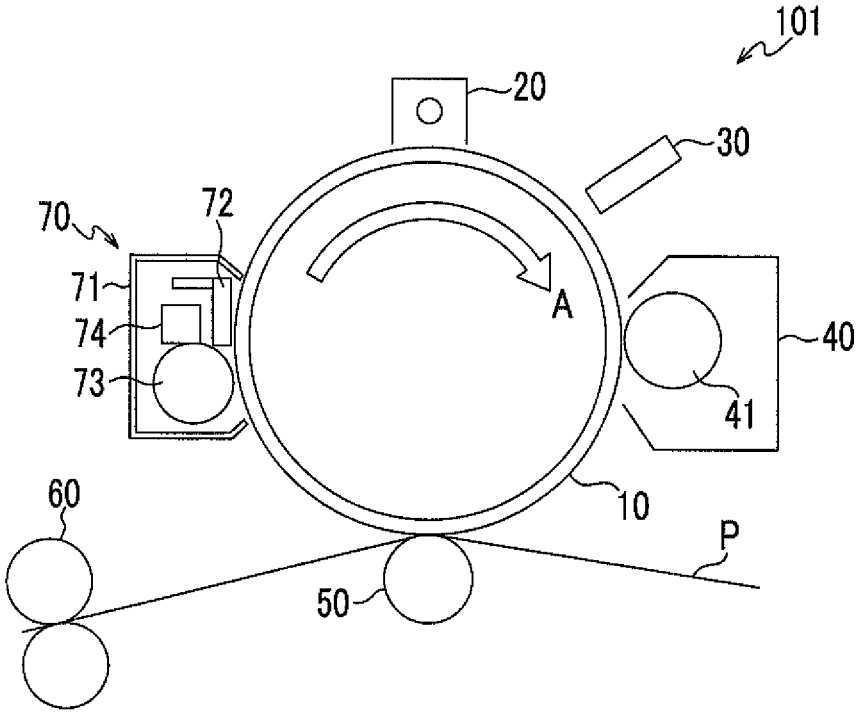
FIG. 4 is a diagram schematically illustrating a configuration of an image forming apparatus according to an exemplary embodiment of the invention.

FIG. 4 is a diagram schematically illustrating a configuration of an image forming apparatus according to an exemplary embodiment of the invention.

As shown in FIG. 4, an image forming apparatus 101 according to this exemplary embodiment is provided with, for example, an electrophotographic photoreceptor 10 that rotates in a clockwise direction as shown by the arrow A, a charging device 20 (an example of charging unit) that is provided above the electrophotographic photoreceptor 10 to face the electrophotographic photoreceptor 10 and to charge a surface of the electrophotographic photoreceptor 10, an exposure device 30 (an example of electrostatic latent image forming unit) that exposes the surface of the electrophotographic photoreceptor 10 charged by the charging device 20 to form an electrostatic latent image, a developing device 40 (an example of developing unit) that adheres a toner contained in a developer to the electrostatic latent image formed using the exposure device 30 to form a toner image on the surface of the electrophotographic photoreceptor 10, a transfer device 50 that causes recording paper P (transfer medium) to be charged with a polarity different from the charging polarity of the toner to transfer the toner image on the electrophotographic photoreceptor 10 onto the recording paper P, and a cleaning device 70 (an example of toner removing unit) that cleans the surface of the electrophotographic photoreceptor 10. In addition, a fixing device 60 is provided to fix the toner image while transporting the recording paper P with the toner image formed thereon.

Hereinafter, the major constituent members in the image forming apparatus 101 according to this exemplary embodiment will be described in detail.

Charging Device

Examples of the charging device 20 include contact-type charging units using a conductive charging roller, a charging brush, a charging film, a charging rubber blade, a charging tube, and the like. In addition, examples of the charging device 20 also include well-known charging units such as non-contact-type roller charging units, and scorotron charging units and corotron charging units using corona discharge. A contact-type charging unit is preferable as the charging device 20.

Exposure Device

Examples of the exposure device 30 include optical equipment that exposes the surface of the electrophotographic photoreceptor 10 with light such as semiconductor laser light, LED light, or liquid crystal shutter light in the form of an image. The wavelength of a light source is preferably in the spectral sensitivity region of the electrophotographic photoreceptor 10. As for the wavelength of the semiconductor laser, for example, a near-infrared laser having an oscillation wavelength of approximately 780 nm may be preferably used. However, the wavelength is not limited thereto, and a laser having an oscillation wavelength of about 600 nm or a laser having an oscillation wavelength of from 400 nm to 450 nm as a blue laser may also be used. In addition, as the exposure device 30, it is also effective to use a surface-emitting laser light source that outputs multi-beams in order to form a color image for example.

Developing Device

Examples of the configuration of the developing device 40 include a configuration in which a developing roll 41 arranged in a developing region so as to be opposed to the electrophotographic photoreceptor 10 is provided in a container accommodating a two-component developer formed of a toner and a carrier. The developing device 40 is not particularly limited as long as it performs the development with a two-component developer, and a known configuration is employed.

Here, the developer for use in the developing device 40 will be described.

The developer may be a single-component developer formed of a toner, or may be a two-component developer containing a toner and a carrier.

The toner contains, for example, toner particles containing a binder resin, a colorant, and if necessary, other additives such as a release agent, and if necessary, an external additive.

The average shape factor of the toner particles (a number average of the shape factor represented by the expression: shape factor=$(ML^2/A)\times(\pi/4)\times100$, where ML represents a maximum length of the particle and A represents a projected area of the particle) is preferably from 100 to 150, more preferably from 105 to 145, and even more preferably from 110 to 140. Furthermore, a volume average particle diameter of the toner is preferably from 3 μm to 12 μm, more preferably from 3.5 μm to 10 μm, and even more preferably from 4 μm to 9 μm.

Although the method of manufacturing the toner particles is not particularly limited, toner particles are used that are manufactured by, for example, a kneading and pulverizing method in which a binder resin, a colorant, a release agent, and if necessary, a charge-controlling agent and the like are added, and the resultant mixture is kneaded, pulverized and classified; a method in which the shapes of the particles obtained using the kneading and pulverizing method are changed by a mechanical impact force or thermal energy; an emulsion polymerization and aggregation method in which polymerizable monomers of a binder resin are subjected to emulsion polymerization, the resultant dispersion formed and a dispersion of a colorant, a release agent, and if necessary, a charge-controlling agent and the like are mixed, aggregated, and heat-melted to obtain toner particles; a suspension polymerization method in which polymerizable monomers for obtaining a binder resin, a solution of a colorant, a release agent, and if necessary, a charge-controlling agent are suspended in an aqueous solvent and polymerization is performed; and a dissolution suspension method in which a binder resin, a solution of a colorant, a release agent, and if necessary, a charge-controlling agent are suspended in an aqueous solvent and granulation is performed.

In addition, a known method such as a manufacturing method in which the toner particles obtained using one of the above methods are used as a core to achieve a core shell structure by further making aggregated particles adhere to the toner particles and by coalescing them with heating is used. As the toner manufacturing method, a suspension polymerization method, an emulsion polymerization and aggregation method, and a dissolution suspension method, all of which are used to manufacture the toner particles using an aqueous solvent, are preferable, and an emulsion polymerization and aggregation method is particularly preferable from the viewpoint of controlling the shape and the particle size distribution.

The toner is manufactured by mixing the above toner particles and the above external additive using a Henschel mixer, a V-blender, or the like. In addition, when the toner particles are manufactured in a wet manner, the external additive may be externally added in a wet manner.

In addition, when the toner is used as a two-component developer, the mixing ratio of the toner to the carrier is set to a known ratio. The carrier is not particularly limited. However, preferable examples of the carrier include a carrier in which the surfaces of magnetic particles are coated with a resin.

Transfer Device

Examples of the transfer device 50 include well-known transfer charging units such as contact-type transfer charging units using a belt, a roller, a film, and a rubber blade, and scorotron transfer charging units and corotron transfer charging units using corona discharge.

Cleaning Device

The cleaning device 70 includes, for example, a housing 71, a cleaning blade 72, and a cleaning brush 73 arranged at the downstream side of the cleaning blade 72 in the rotation direction of the electrophotographic photoreceptor 10. In addition, for example, a lubricant 74 in a solid state is arranged to contact with the cleaning brush 73.

Hereinafter, the operation of the image forming apparatus 101 according to this exemplary embodiment will be described. First, when the electrophotographic photoreceptor 10 is rotated in the direction represented by the arrow A, it is negatively charged by the charging device 20 at the same time.

The electrophotographic photoreceptor 10, the surface of which has been negatively charged by the charging device 20, is exposed using the exposure device 30, and a latent image is formed on the surface thereof.

When a part in the electrophotographic photoreceptor 10, in which the latent image has been formed, approaches the developing device 40, the developing device 40 (developing roll 41) adheres a toner to the latent image to form a toner image.

When the electrophotographic photoreceptor 10 having the toner image formed thereon is further rotated in the direction of the arrow A, the transfer device 50 transfers the toner image onto recording paper P. As a result, the toner image is formed on the recording paper P.

The fixing device 60 fixes the toner image to the recording paper P having the image formed thereon.

Figure 5:
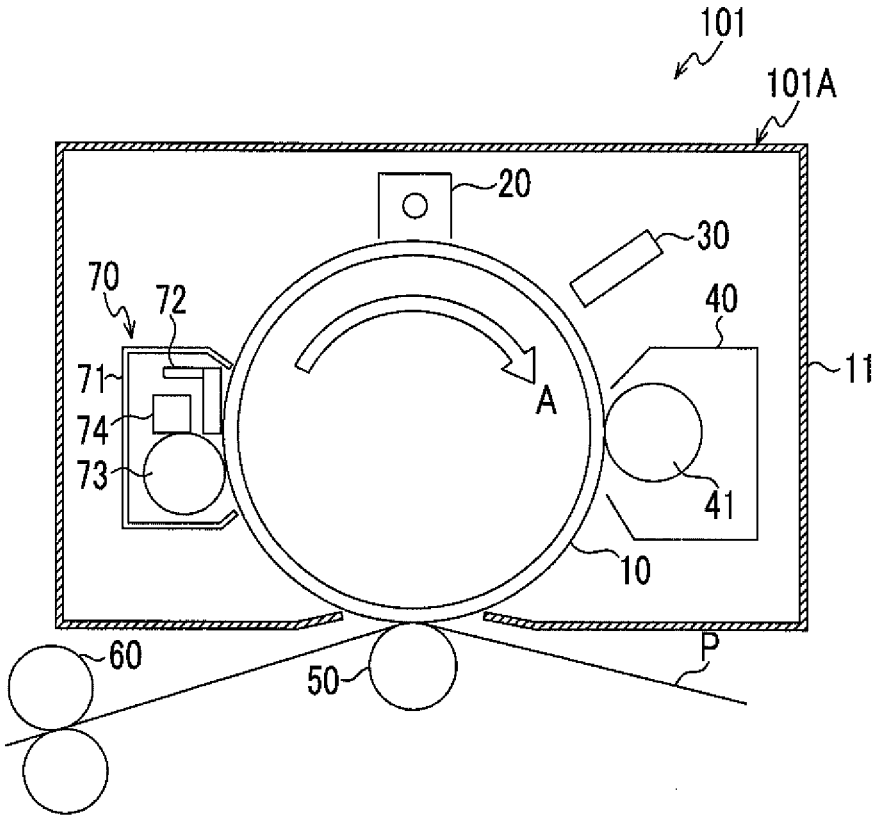
FIG. 5 is a diagram schematically illustrating a configuration of an image forming apparatus according to another exemplary embodiment of the invention.

The image forming apparatus 101 according to this exemplary embodiment may be provided with, for example, a process cartridge 101A that integrally accommodates an electrophotographic photoreceptor 10, a charging device 20, an exposure device 30, a developing device 40, and a cleaning device 70 in a housing 11 as shown in FIG. 5. This process cartridge 101A integrally accommodates plural members and is detachably mounted on the image forming apparatus 101.

The configuration of the process cartridge 101A is not limited thereto. Any configuration is applicable as long as the process cartridge 101A is provided with at least the electrophotographic photoreceptor 10. For example, a configuration may be also applicable in which the process cartridge 101A is provided with at least one selected from the charging device 20, the exposure device 30, the developing device 40, the transfer device 50, and the cleaning device 70.

The image forming apparatus 101 according to this exemplary embodiment is not limited to the above configuration. For example, the image forming apparatus 101 may be provided with a first erasing device, which aligns the polarities of the residual toners to easily remove the residual toners with the cleaning brush, and which is disposed around the electrophotographic photoreceptor 10 at the downstream side of the transfer device 50 in the rotation direction of the electrophotographic photoreceptor 10 and at the upstream side of the cleaning device 70 in the rotation direction of the electrophotographic photoreceptor. The image forming apparatus 101 may also be provided with a second erasing device, which erases charges on the surface of the electrophotographic photoreceptor 10, and which is disposed at the downstream side of the cleaning device 70 in the rotation direction of the electrophotographic photoreceptor and at the upstream side of the charging device 20 in the rotation direction of the electrophotographic photoreceptor.

In addition, the image forming apparatus 101 according to this exemplary embodiment is not limited to the above configuration. For example, a known configuration may be employed such as an intermediate transfer-type image forming apparatus in which a toner image formed on the electrophotographic photoreceptor 10 is transferred onto an intermediate transfer member and is then transferred onto recording paper P or a tandem-type image forming apparatus.

EXAMPLES

The exemplary embodiment will be described in detail using the following Examples and Comparative Examples, but is not limited to the Examples.

Hereinafter, "part(s)" and "%" represent "part(s) by weight" and "% by weight", respectively, unless specified otherwise.

Preparation of Conductive Substrate

Substrate 1

A slag formed of 1070 aluminum (purity=99.5%) is prepared ("1070" means an alloy grade number according to JIS H4000 (1999)), and then subjected to homogenization at 220° C. for 10 hours. Next, the homogenized slag is molded into a cylindrical shape by the impact pressing process. As a result, a cylindrical compact having an outer diameter of 42 mm and a thickness of 0.7 mm is obtained. Next, the cylindrical compact is subjected to the ironing process 4 times. As a result, a cylindrical compact having an outer diameter of 40 mm and a thickness of 0.55 mm is obtained. However, the annealing process is not performed after the ironing process.

The compact, obtained through the above-described processes, is set to a substrate 1.

Substrates 2 to 8

The respective substrates 2 to 8 are prepared in the same preparation method as that of the substrate 1, except that the process conditions are changed as shown in Table 1.

Example 1

Photoreceptor 1

Formation of Undercoat Layer 100 parts by weight of zinc oxide particles (average particle diameter: 70 nm, manufactured by Tayca Corporation, specific surface area: 15 $m^2/g$) is stirred and mixed with 500 parts by weight of toluene. 1.25 parts by weight of silane coupling agent (KBM 603, manufactured by Shin-Etsu Chemical Co., Ltd.) is added thereto, followed by stirring for 2 hours. Then, toluene is removed by distillation under reduced pressure, followed by baking at 120° C. for 3 hours. As a result, zinc oxide particles with the surfaces treated with the silane coupling agent is obtained.

100 parts by weight of the surface-treated zinc oxide particles is added to 500 parts by weight of tetrahydrofuran, followed by stirring and mixing. A solution, obtained by dissolving 1 part by weight of alizarin in 50 parts by weight of tetrahydrofuran, is added thereto, followed by stirring at 50° C. for 5 hours. Then, zinc oxide particles to which alizarin is added are separated by filtration under reduced pressure, followed by drying under reduced pressure at 60° C. As a result, alizarin-added zinc oxide particles are obtained.

60 parts by weight of the obtained alizarin-added zinc oxide particles, 13.5 parts by weight of curing agent (blocked isocyanate SUMIDUR 3173, manufactured by Sumitomo-Bayer Urethane Co., Ltd.), and 15 parts by weight of butyral resin (S-LEC BM-1, manufactured by Sekisui Chemical Co., Ltd.) are dissolved in 85 parts by weight of methyl ethyl ketone to prepare a solution. 38 parts by weight of the obtained solution is mixed with 25 parts by weight of methyl ethyl ketone, followed by dispersion for 2 hours using a sand mill with 1 mm diameter glass beads. As a result, a dispersion is obtained.

0.005 part by weight of dioctyl tin dilaurate as a catalyst and 40 parts by weight of silicone resin particles (TOSPEARL 145, manufactured by GE Toshiba Silicones Co., Ltd.) are added to this obtained dispersion, followed by drying and curing at 170° C. for 40 minutes. As a result, an undercoat layer-forming coating solution is obtained.

This coating solution is dip-coated on the substrate 1 using a dip coating method. As a result, an undercoat layer having a thickness of 20 μm is obtained.

Formation of Charge Generation Layer

Next, 1 part by weight of chlorogallium phthalocyanine crystal having distinctive diffraction peaks with respect to CuKα characteristic X-rays at Bragg angles (2θ±0.2°) of at least 7.4°, 16.6°, 25.5°, and 28.3°; and 1 part by weight of polyvinyl butyral resin (trade name: S-LEC BM-S, manufactured by Sekisui Chemical Co., Ltd.) are added to 100 parts by weight of butyl acetate, followed by dispersion using glass beads and a paint shaker for 1 hour. The obtained coating solution is dip-coated on a surface of the undercoat layer, followed by heating and drying at 100° C. for 10 minutes. As a result, a charge generation layer having a thickness of 0.2 μm is formed.

Formation of Charge Transport Layer 2.1 parts by weight of compound 1 represented by the following formula and 2.9 parts by weight of polymer compound (viscosity average molecular weight: 39,000) represented by Structural Formula 1 are dissolved in 10 parts by weight of tetrahydrofuran and 5 parts by weight of toluene. As result, a coating solution is prepared. This obtained coating solution is dip-coated on a surface of the charge generation layer, followed by heating and drying at 135° C. for 35 minutes. As a result, a charge transport layer having a thickness of 24 μm is formed.

Compound 1

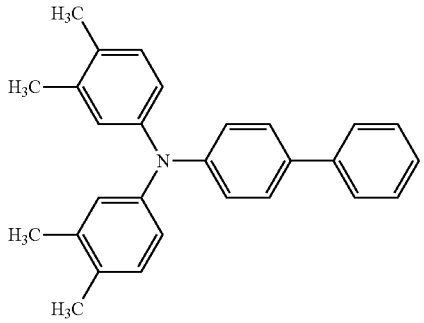

Structural Formula 1

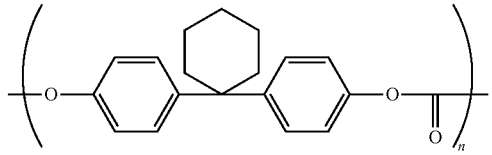

Formation of Surface Protective Layer 10 parts by weight of LUBRON L-2 as polytetrafluoroethylene resin particles (manufactured by DAIKIN INDUSTRIES Ltd., average primary particle diameter: 0.2 μm) and 0.5 parts by weight of alky fluoride group-containing copolymer containing a repeating unit represented by Structural Formula 2 (weight average molecular weight: 50,000, 13:m3=1:1, s3=1, n3=60) are added to 40 parts by weight of mixed solvent (cyclopentanone:cyclopentanol=7:3), followed by mixing and stirring. The obtained solution is dispersed 5 times at an increased pressure upto 700 kgf/cm$^2$ using a high-pressure homogenizer (manufactured by Yoshida Kikai Co., Ltd., YSNM-1500AR) equipped with a pass-through type chamber having a flow path. As a result, a polytetrafluoroethylene resin particle suspension (A) is prepared.

Structural Formula 2

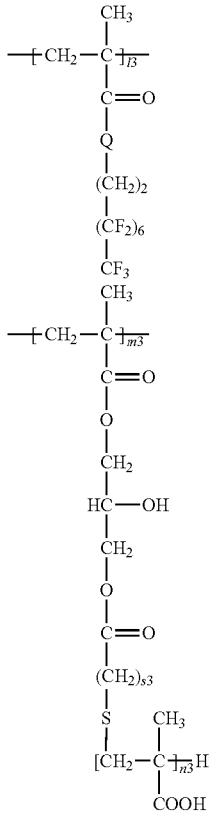

Next, 55 parts by weight of the exemplary compound (I-8) and 40 parts by weight of the exemplary compound (T-26) as the reactive charge transport materials; 4 parts by weight of benzoguanamine resin as another resin (the exemplary compound (A)-17, NIKALAC BL-60, manufactured by Sanwa Chemical Co., Ltd.); 1 part by weight of dimethylpolysiloxane (GLANOL 450, manufactured by Kyoeisha Chemical Co., Ltd.); and 0.1 parts by weight of NACURE 5225 (manufactured by King Industries Inc.) are dissolved in a mixed solvent (cyclopentanone:cyclopentanol=7:3), followed by stirring at 40° C. for 6 hours. As a result, a solution (B) is prepared.

Furthermore, 110 parts by weight of the polytetrafluoroethylene resin particle suspension (A) and 100 parts by weight of the solution (B) are mixed with each other to prepare a surface protective layer-forming coating solution.

The obtained surface protective layer-forming coating solution is coated on the charge transport layer in an inkjet coating method, followed by drying at 155° C. for 35 minutes. As a result, a surface protective layer having a thickness of 6 μm is formed.

Through the above-described processes, an electrophotographic photoreceptor is prepared. This electrophotographic photoreceptor is set to a photoreceptor 1.

Examples 2 to 7 and Comparative Examples 1 to 5

Photoreceptors 2 to 12

Photoreceptors 2 to 12 according to Examples 2 to 7 and Comparative Examples 1 to 5 are prepared with the same preparation method as that of the photoreceptor 1 according to Example 1, except that the conductive substrate to be used; and the reactive charge transport material and another resin used for the surface protective layer are changed as shown in Table 1.

Evaluation

Characteristics of Conductive Substrate and Surface Protective Layer

The thickness and Young's modulus of the conductive substrate in the photoreceptor prepared in each example are measured according to the above-described method. In addition, the outer diameter and length of the conductive substrate are also measured.

The elastic deformation ratio of the surface protective layer in the photoreceptor prepared in each example is also measured according to the above-described method.

Evaluation for Photoreceptor

Evaluation for Image Quality

The photoreceptor prepared in each example is mounted to a process cartridge (CRU=Customer Replaceable Unit) of an image forming apparatus (manufactured by Fuji Xerox Co., Ltd., "DocuCentre-II 7500 (which is modified so as to form an image at 150 sheet/min)).

After being fallen from a height of 1.5 m, the process cartridge is mounted to the image forming apparatus and an image forming test is performed.

In the image forming test, 15,000 images (2 on-2 off fine line images (line images in which 2 dots of lines and 2 dots of spaces are repeatedly formed)) having an image density of 5% are printed on A4 paper in a high temperature and high humidity (28° C., 80% RH) environment under conditions of a monochrome mode and a rate of 150 sheet/min. The 14,800th printed image is evaluated for image quality by visual inspection.

The evaluation criteria are as follows.

A: The 2 on-2 off line pair is completely resolved

B: The 2 on-2 off line pair is not clearly resolved

C: The 2 on-2 off line pair is not resolved

Evaluation for Cracking and Peeling

After the image quality is evaluated, the photoreceptor is removed from the image forming apparatus. Then, the cracking and peeling state of layers formed on the conductive substrate (outer peripheral surface) are evaluated by visual inspection.

The evaluation criteria are as follows.

Cracking

A: The cracking is not observed

B: The cracking is visually observed

Peeling

A: The peeling is not observed

B: The peeling is visually observed

Tables 1 and 2 show a list of the details of the conductive substrate and the details of Examples and Comparative Examples.

TABLE 1

| | Process Conditions | | | | Dimension | | |
|---|---|---|---|---|---|---|---|
| | Slag Homogenizing Process | Thickness of Cylindrical Compact After Impact Pressing Process | Number of Ironing Process | Annealing Process | Outer Diameter | Thickness | Young's Modulus |
| Substrate 1 | 220° C., 10 Hours | 0.7 mm | 4 Times | None | 40.0 mm | 0.55 mm | 35 GPa |
| Substrate 2 | 220° C., 10 Hours | 0.6 mm | 4 Times | None | 40.0 mm | 0.40 mm | 35 GPa |
| Substrate 3 | 220° C., 10 Hours | 0.7 mm | 2 Times | None | 40.0 mm | 0.60 mm | 35 GPa |
| Substrate 4 | 220° C., 10 Hours | 0.7 mm | 4 Times | 220° C., 10 Hours | 40.0 mm | 0.55 mm | 75 GPa |
| Substrate 5 | 220° C., 10 Hours | 0.7 mm | 4 Times | 220° C., 10 Hours | 40.0 mm | 0.55 mm | 58 GPa |
| Substrate 6 | 220° C., 10 Hours | 0.6 mm | 5 Times | None | 40.0 mm | 0.35 mm | 35 GPa |
| Substrate 7 | 220° C., 10 Hours | 0.7 mm | 1 Time | None | 40.0 mm | 0.65 mm | 35 GPa |
| Substrate 8 | 260° C., 5 hours | 0.7 mm | 4 Times | 260° C., 10 Hours | 40.0 mm | 0.55 mm | 85 GPa |

TABLE 2

| | | Substrate | | | Surface Protective Layer | | | Elastic | Evaluation | | |
|---|---|---|---|---|---|---|---|---|---|---|---|
| | Photoreceptor No. | No. | Thickness | Young's Modulus | Reactive Charge Transport Material | | Another Resin | Deformation Ratio | Cracking | Peeling | Image Quality |
| Ex. 1 | Photoreceptor 1 | 1 | 0.55 mm | 35 GPa | (I-8)/55 Parts | (I-26)/40 parts | (A)-17/4 Parts | 0.40% | A | A | A |
| Ex. 2 | Photoreceptor 2 | 1 | 0.55 mm | 35 GPa | (I-8)/60 Parts | (I-26)/31 parts | (A)-17/8 Parts | 0.35% | A | A | A |
| Ex. 3 | Photoreceptor 3 | 2 | 0.40 mm | 35 GPa | (I-8)/60 Parts | (I-26)/31 parts | (A)-17/8 Parts | 0.35% | A | A | A |
| Ex. 4 | Photoreceptor 4 | 3 | 0.60 mm | 35 GPa | (I-16)/60 Parts | (I-26)/40 parts | (A)-17/4 Parts | 0.47% | A | A | A |
| Ex. 5 | Photoreceptor 5 | 2 | 0.40 mm | 35 GPa | (I-16)/60 Parts | (I-26)/40 parts | (A)-17/4 Parts | 0.47% | A | A | A |
| Ex. 6 | Photoreceptor 6 | 4 | 0.55 mm | 75 GPa | (I-8)/55 Parts | (I-26)/40 parts | (A)-17/4 Parts | 0.40% | A | A | A |
| Ex. 7 | Photoreceptor 7 | 5 | 0.55 mm | 58 GPa | (I-8)/55 Parts | (I-26)/40 parts | (A)-17/4 Parts | 0.40% | A | A | A |
| Comp. Ex. 1 | Photoreceptor 8 | 6 | 0.35 mm | 35 GPa | (I-8)/55 Parts | (I-26)/40 parts | (A)-17/4 Parts | 0.40% | A | B | A |
| Comp. Ex. 2 | Photoreceptor 9 | 7 | 0.65 mm | 35 GPa | (I-8)/55 Parts | (I-26)/40 parts | (A)-17/4 Parts | 0.40% | B | A | A |
| Comp. Ex. 3 | Photoreceptor 10 | 8 | 0.55 mm | 85 GPa | (I-8)/60 Parts | (I-26)/31 parts | (A)-17/8 Parts | 0.35% | B | A | A |
| Comp. Ex. 4 | Photoreceptor 11 | 1 | 0.55 mm | 35 GPa | (I-8)/70 Parts | (I-26)/25 parts | (A)-17/4 Parts | 0.30% | B | A | A |
| Comp. Ex. 5 | Photoreceptor 12 | 1 | 0.55 mm | 35 GPa | (I-16)/65 Parts | (I-26)/30 parts | (A)-17/4 Parts | 0.50% | A | A | C Image Blurring |

It has been found that from the above results that Examples show superior results to Comparative Examples in the evaluation for cracking and peeling and the evaluation for image quality.

Hereinafter, the details in the tables will be described.

Reactive Charge Transport Material (I-8): Exemplary Compound (I-8)

(I-26): Exemplary Compound (I-26)

Another Resin (A)-1: Benzaguanamine Resin (NIKALAC BL-60, Manufactured by Sanwa Chemical Co., Ltd.)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a cylindrical conductive substrate that has a thickness of from 0.4 mm to 0.6 mm and a Young's modulus of from 20 GPa to 80 GPa; and a photosensitive layer that is provided on the conductive substrate, wherein an elastic deformation ratio of a layer forming the outermost surface is from 0.35% to 0.47%.

2. The electrophotographic photoreceptor according to claim 1, wherein the Young's modulus of the conductive substrate is from 30 GPa to 70 GPa.

3. The electrophotographic photoreceptor according to claim 1, wherein the Young's modulus of the conductive substrate is from 30 GPa to 50 GPa.

4. The electrophotographic photoreceptor according to claim 1, wherein the thickness of the conductive substrate is from 0.5 mm to 0.6 mm.

5. The electrophotographic photoreceptor according to claim 1, wherein the conductive substrate is an aluminum substrate.

6. The electrophotographic photoreceptor according to claim 1, wherein the elastic deformation ratio of the layer forming the outermost surface is from 0.37% to 0.45%.

7. The electrophotographic photoreceptor according to claim 1, wherein the elastic deformation ratio of the layer forming the outermost surface is from 0.4% to 0.44%.

8. The electrophotographic photoreceptor according to claim 1, wherein the layer forming the outermost surface contains a cured film of a composition that contains a reactive charge transport material having an —OH group as a reactive functional group and a reactive charge transport material having an —$OCH_3$ group as a reactive functional group.

9. The electrophotographic photoreceptor according to claim 8, wherein a content of the reactive charge transport material having an —$OCH_3$ group as a reactive function group in the composition is from 0.1 time to 3.0 times that of the reactive charge transport material having an —OH group.

10. The electrophotographic photoreceptor according to claim 8, wherein a content of the reactive charge transport material having an —$OCH_3$ group as a reactive function group in the composition is from 0.3 time to 1.0 time that of the reactive charge transport material having an —OH group.

11. The electrophotographic photoreceptor according to claim 1, wherein the layer forming the outermost surface is a surface protective layer that is provided on the photosensitive layer.

12. The electrophotographic photoreceptor according to claim 1, wherein the photosensitive layer includes a charge generation layer and a charge transport layer formed on the charge generation layer, and the layer forming the outermost surface is the charge transport layer.

13. A process cartridge, which is detachable from an image forming apparatus, comprising:

the electrophotographic photoreceptor according to claim 1.

14. An image forming apparatus comprising:

the electrophotographic photoreceptor according to claim 1;

a charging unit that charges the electrophotographic photoreceptor;

an electrostatic latent image forming unit that forms an electrostatic latent image on a charged electrophotographic photoreceptor;

a developing unit that accommodates a developer containing a toner and develops the electrostatic latent image, formed on the electrophotographic photoreceptor, using the developer to form a toner image; and a transfer unit that transfers the toner image onto a transfer medium.

* * * * *